US008528163B2

(12) United States Patent
Park et al.

(10) Patent No.: US 8,528,163 B2
(45) Date of Patent: Sep. 10, 2013

(54) VACUUM CLEANER

(75) Inventors: Sang-Jun Park, Changwon (KR); Young-Min Hyun, Changwon (KR); Hyuk-Joo Kwon, Changwon (KR); Hyo-Churl Shin, Changwon (KR); Hae-Seock Yang, Changwon (KR); Jin-Wook Seo, Changwon (KR)

(73) Assignee: LG Electronics Inc., Seoul (KR)

( * ) Notice: Subject to any disclaimer, the term of this patent is extended or adjusted under 35 U.S.C. 154(b) by 680 days.

(21) Appl. No.: 12/704,915

(22) Filed: Feb. 12, 2010

(65) Prior Publication Data

US 2010/0199457 A1 Aug. 12, 2010

Related U.S. Application Data

(60) Provisional application No. 61/151,982, filed on Feb. 12, 2009.

(51) Int. Cl.
*A47L 9/10* (2006.01)
*A47L 9/20* (2006.01)

(52) U.S. Cl.
USPC ..... 15/352

(58) Field of Classification Search
USPC ..... 15/352
See application file for complete search history.

(56) References Cited

U.S. PATENT DOCUMENTS

| | | | | |
|---|---|---|---|---|
| 83,469 | A | 10/1868 | Crandall | 183/38 |
| 2,283,836 | A | 5/1942 | White | 183/38 |
| 2,714,426 | A | 8/1955 | White | 183/58 |
| 3,367,462 | A | 2/1968 | Bibbens | 192/55 |
| 4,379,385 | A | 4/1983 | Reinhall | 56/16.6 |
| 4,545,794 | A | 10/1985 | Himukai | 55/362 |
| 4,601,082 | A | 7/1986 | Kurz | 15/319 |
| 4,617,034 | A | 10/1986 | Ikezaki et al. | 55/276 |
| 4,809,394 | A | 3/1989 | Suka et al. | 15/327 |
| 5,033,151 | A | 7/1991 | Kraft et al. | 15/319 |
| 5,135,552 | A | 8/1992 | Weistra | 55/337 |
| 5,159,738 | A | 11/1992 | Sunagawa et al. | 15/326 |
| 5,233,682 | A | 8/1993 | Abe et al. | 395/61 |
| 5,251,358 | A | 10/1993 | Moro et al. | 15/319 |
| 5,265,305 | A | 11/1993 | Kraft et al. | 15/319 |
| 5,323,483 | A | 6/1994 | Baeg | 288/811 |
| 5,542,146 | A | 8/1996 | Hoekstra et al. | 15/319 |
| 6,192,550 | B1 * | 2/2001 | Hamada et al. | 15/352 |
| 6,460,217 | B2 | 10/2002 | Fukushima et al. | 15/346 |
| 6,572,668 | B1 | 6/2003 | An et al. | |

(Continued)

FOREIGN PATENT DOCUMENTS

| | | | |
|---|---|---|---|
| AU | 2005229774 | A1 | 8/2006 |
| AU | 2007200406 | B2 | 9/2007 |

(Continued)

OTHER PUBLICATIONS

U.S. Notice of Allowance issued in U.S. Appl. No. 12/407,293 dated Jun. 29, 2011.

(Continued)

*Primary Examiner* — Bryan R Muller
(74) *Attorney, Agent, or Firm* — KED & Associates LLP

(57) ABSTRACT

A vacuum cleaner is provided. The vacuum cleaner may include a dust separation device that separates dust and a dust container in which the dust separated in the dust separation device may be stored.

14 Claims, 38 Drawing Sheets

(56) References Cited

U.S. PATENT DOCUMENTS

| | | | | |
|---|---|---|---|---|
| 6,589,306 | B2 | 7/2003 | Ronning et al. | |
| 6,625,845 | B2 | 9/2003 | Matsumoto et al. | 15/353 |
| 6,689,225 | B2 | 2/2004 | Illingworth | 134/21 |
| 6,694,917 | B1 | 2/2004 | Wang | 119/51.11 |
| 6,735,816 | B2 | 5/2004 | Oh et al. | 15/353 |
| 6,757,933 | B2 | 7/2004 | Oh et al. | 15/353 |
| 6,779,229 | B2 | 8/2004 | Lee et al. | 15/329 |
| 6,782,584 | B2 | 8/2004 | Choi | 15/352 |
| 6,922,868 | B1 | 8/2005 | Jeong | 15/353 |
| 7,028,369 | B2 | 4/2006 | Park et al. | 15/353 |
| 7,152,276 | B2 | 12/2006 | Jin et al. | 15/352 |
| 7,351,269 | B2 | 4/2008 | Yau | 55/297 |
| 7,475,449 | B2 | 1/2009 | Lee | 15/326 |
| 7,481,868 | B2 | 1/2009 | Lee et al. | 95/273 |
| 7,547,340 | B2 | 6/2009 | Park | 55/429 |
| 7,582,128 | B2 | 9/2009 | Hwang et al. | 55/337 |
| 7,601,188 | B2 | 10/2009 | Hwang et al. | 55/343 |
| 7,608,123 | B2 | 10/2009 | Pineschi | 55/429 |
| 7,640,625 | B2 | 1/2010 | Oh et al. | 15/352 |
| 7,644,469 | B2 | 1/2010 | Beers et al. | 15/319 |
| 7,647,672 | B2 | 1/2010 | Nam et al. | 15/352 |
| 7,704,290 | B2 | 4/2010 | Oh | 55/295 |
| 7,749,295 | B2 | 7/2010 | Hwang et al. | 55/428 |
| 7,770,253 | B2 | 8/2010 | Ha et al. | 15/319 |
| 7,785,381 | B2 | 8/2010 | Oh et al. | 55/300 |
| 7,785,396 | B2 | 8/2010 | Hwang et al. | 95/1 |
| 7,854,782 | B2 | 12/2010 | Oh et al. | 55/429 |
| 7,951,216 | B2 | 5/2011 | Ha et al. | |
| 7,958,598 | B2 | 6/2011 | Yun et al. | |
| 2001/0025395 | A1 | 10/2001 | Matsumoto et al. | 15/353 |
| 2002/0073505 | A1 | 6/2002 | Bolden | 15/340.1 |
| 2002/0088079 | A1 | 7/2002 | Oh | 15/352 |
| 2002/0124538 | A1 | 9/2002 | Oh et al. | 55/426 |
| 2004/0211025 | A1 | 10/2004 | Jung et al. | 15/353 |
| 2004/0261216 | A1 | 12/2004 | Choi et al. | 15/352 |
| 2005/0091787 | A1 | 5/2005 | Bair et al. | 15/353 |
| 2005/0138763 | A1 | 6/2005 | Tanner et al. | 15/353 |
| 2005/0172584 | A1 | 8/2005 | Oh et al. | 55/345 |
| 2005/0252179 | A1 | 11/2005 | Oh et al. | 55/337 |
| 2006/0048491 | A1 | 3/2006 | Pineschi | |
| 2006/0123750 | A1 | 6/2006 | Lee et al. | 55/428 |
| 2006/0230722 | A1 | 10/2006 | Oh et al. | |
| 2007/0136980 | A1 | 6/2007 | Fujiwara et al. | 15/339 |
| 2007/0143953 | A1 | 6/2007 | Hwang et al. | 15/353 |
| 2007/0209149 | A1 | 9/2007 | Lee | 15/352 |
| 2007/0209339 | A1 | 9/2007 | Conrad | 55/345 |
| 2008/0023035 | A1 | 1/2008 | Ha et al. | 134/18 |
| 2008/0023036 | A1* | 1/2008 | Ha et al. | 134/21 |
| 2008/0047094 | A1 | 2/2008 | Ha et al. | 15/347 |
| 2008/0052870 | A1 | 3/2008 | Lee et al. | 15/350 |
| 2008/0172824 | A1 | 7/2008 | Yun et al. | 15/352 |
| 2008/0172993 | A1 | 7/2008 | Yun et al. | 55/337 |
| 2008/0263816 | A1 | 10/2008 | Oh et al. | 15/347 |
| 2008/0264007 | A1 | 10/2008 | Oh et al. | 55/304 |
| 2008/0264014 | A1 | 10/2008 | Oh et al. | 55/423 |
| 2008/0264015 | A1 | 10/2008 | Oh et al. | 55/429 |
| 2008/0264016 | A1* | 10/2008 | Oh et al. | 55/429 |
| 2009/0178231 | A1 | 7/2009 | Hwang et al. | 15/347 |
| 2009/0178235 | A1 | 7/2009 | Yun et al. | 15/352 |
| 2009/0178236 | A1 | 7/2009 | Yun et al. | 15/352 |
| 2009/0229072 | A1 | 9/2009 | Hwang et al. | 15/352 |
| 2009/0229073 | A1 | 9/2009 | Hwang et al. | 15/352 |
| 2009/0235956 | A1 | 9/2009 | Hwang et al. | 134/21 |
| 2009/0241286 | A1 | 10/2009 | Hwang et al. | 15/347 |
| 2009/0249578 | A1 | 10/2009 | Hwang et al. | 15/352 |
| 2009/0255083 | A1 | 10/2009 | Hwang et al. | 15/347 |
| 2009/0266382 | A1 | 10/2009 | Hwang et al. | 134/21 |
| 2009/0293221 | A1 | 12/2009 | Hwang et al. | 15/347 |
| 2009/0293223 | A1 | 12/2009 | Hwang et al. | 15/352 |
| 2009/0293224 | A1 | 12/2009 | Hyun et al. | 15/353 |
| 2009/0293915 | A1 | 12/2009 | Hwang et al. | 134/21 |
| 2010/0132319 | A1 | 6/2010 | Ashbee et al. | |

FOREIGN PATENT DOCUMENTS

| | | | |
|---|---|---|---|
| CN | 2162679 | Y | 4/1994 |
| CN | 2186039 | Y | 12/1994 |
| CN | 2409894 | Y | 12/2000 |
| CN | 1334061 | A | 2/2002 |
| CN | 1434749 | A | 8/2003 |
| CN | 1593324 | A | 3/2005 |
| CN | 1695537 | A | 11/2005 |
| CN | 1695538 | A | 11/2005 |
| CN | 1777385 | A | 5/2006 |
| CN | 1778246 | A | 5/2006 |
| DE | 102 40 618 | A1 | 9/2003 |
| EP | 0 373 353 | | 6/1990 |
| EP | 0 375 327 | | 6/1990 |
| EP | 0 681 808 | | 11/1995 |
| EP | 1 136 028 | B1 | 9/2001 |
| EP | 1 371 318 | A2 | 12/2003 |
| EP | 1 671 569 | | 6/2006 |
| EP | 1 671 570 | A1 | 6/2006 |
| EP | 1 733 669 | A1 | 12/2006 |
| EP | 1 857 032 | A2 | 11/2007 |
| FR | 2 823 091 | A1 | 10/2002 |
| GB | 2 368 516 | A | 5/2002 |
| GB | 2 377 881 | A | 1/2003 |
| GB | 2 388 769 | B | 4/2004 |
| GB | 2 404 887 | A | 2/2005 |
| GB | 2 406 064 | A | 3/2005 |
| GB | 2 416 721 | A | 2/2006 |
| GB | 2466625 | | 6/2010 |
| JP | 1972-14759 | | 8/1972 |
| JP | 50-22355 | | 3/1975 |
| JP | 53-051663 | | 5/1978 |
| JP | 54-028457 | | 3/1979 |
| JP | 54-51259 | | 4/1979 |
| JP | 54-085560 | A | 7/1979 |
| JP | 54-085561 | A | 7/1979 |
| JP | 54-112357 | | 8/1979 |
| JP | 54-114358 | U | 8/1979 |
| JP | 54-114366 | U | 8/1979 |
| JP | 54-114367 | U | 8/1979 |
| JP | 54-119272 | U | 8/1979 |
| JP | 54-161751 | A | 12/1979 |
| JP | 55-074553 | U | 5/1980 |
| JP | 56-26044 | U | 3/1981 |
| JP | 58-84066 | A | 5/1983 |
| JP | 58-175532 | A | 10/1983 |
| JP | 58-218934 | A | 12/1983 |
| JP | 59-125354 | U | 8/1984 |
| JP | 64-029246 | A | 1/1989 |
| JP | 02-007927 | A | 1/1990 |
| JP | 4-116933 | U | 10/1992 |
| JP | 06-054778 | A | 3/1994 |
| JP | 07-241265 | A | 9/1995 |
| JP | 07-313412 | | 12/1995 |
| JP | 08-000514 | A | 1/1996 |
| JP | 08-112223 | A | 5/1996 |
| JP | 08-140907 | A | 6/1996 |
| JP | 10-243900 | A | 9/1998 |
| JP | 11-004789 | A | 1/1999 |
| JP | 2000-262449 | A | 9/2000 |
| JP | 2002-143060 | A | 5/2002 |
| JP | 2002-187336 | A | 7/2002 |
| JP | 2002-360474 | A | 12/2002 |
| JP | 2003-019097 | A | 1/2003 |
| JP | 2003-119575 | A | 4/2003 |
| JP | 2003-125995 | A | 5/2003 |
| JP | 2003-190056 | A | 7/2003 |
| JP | 2003-199695 | A | 7/2003 |
| JP | 2003-524522 | A | 8/2003 |
| JP | 2003-310502 | A | 11/2003 |
| JP | 2003-310506 | A | 11/2003 |
| JP | 2004-065357 | A | 3/2004 |
| JP | 2004-528087 | A | 9/2004 |
| JP | 2004-528876 | | 9/2004 |
| JP | 2005-034213 | A | 2/2005 |
| JP | 2005-324002 | | 11/2005 |
| JP | 2006-3119575 | U | 2/2006 |
| JP | 2006-061439 | A | 3/2006 |
| JP | 2006-068500 | A | 3/2006 |

| | | | |
|---|---|---|---|
| JP | 2006-340972 | | 12/2006 |
| JP | 2007-007381 | A | 1/2007 |
| JP | 2008-073066 | A | 4/2008 |
| KR | 10-1993-0008369 | B1 | 8/1993 |
| KR | 10-1995-0016643 | | 7/1995 |
| KR | 10-1999-0050243 | | 7/1999 |
| KR | 10-1999-0055544 | | 7/1999 |
| KR | 20-2000-0011635 | | 7/2000 |
| KR | 10-2002-0091510 | A | 12/2002 |
| KR | 10-2005-0005611 | A | 1/2005 |
| KR | 10-2005-0013694 | A | 2/2005 |
| KR | 10-2005-0040122 | | 5/2005 |
| KR | 10-0546629 | B1 | 1/2006 |
| KR | 10-0553042 | B1 | 2/2006 |
| KR | 10-2006-0031442 | A | 4/2006 |
| KR | 10-2006-0116992 | A | 11/2006 |
| KR | 10-0730956 | B1 | 6/2007 |
| KR | 10-2007-084834 | A | 8/2007 |
| KR | 10-2007-0088022 | A | 8/2007 |
| KR | 10-2007-0088023 | | 8/2007 |
| KR | 10-2007-0112324 | | 11/2007 |
| KR | 10-2007-0113353 | | 11/2007 |
| KR | 10-0800188 | B1 | 1/2008 |
| KR | 10-0800189 | B1 | 1/2008 |
| KR | 10-0838886 | B1 | 6/2008 |
| KR | 10-0838887 | B1 | 6/2008 |
| RU | 2 172 132 | C1 | 8/2001 |
| RU | 2 243 714 | C1 | 1/2005 |
| RU | 2 269 919 | C2 | 9/2005 |
| SU | 1326236 | A1 | 7/1987 |
| WO | WO 00/74548 | A1 | 12/2000 |
| WO | WO 01/35809 | A1 | 5/2001 |
| WO | WO 01/60524 | A1 | 8/2001 |
| WO | WO 2004/064591 | A2 | 8/2004 |
| WO | WO 2005/099545 | A1 | 10/2005 |
| WO | WO 2008/114966 | | 9/2008 |

OTHER PUBLICATIONS

U.S. Office Action issued in U.S. Appl. No. 12/407,243 dated Jul. 18, 2011.
U.S. Office Action issued in U.S. Appl. No. 12/404,692 dated Jul. 20, 2011.
U.S. Office Action issued in U.S. Appl. No. 12/404,715 dated Jul. 22, 2011.
U.S. Office Action issued in U.S. Appl. No. 12/407,975 dated Jul. 28, 2011.
Russian Office Action dated Oct. 19, 2010 issued in Application No. 2009143355 (with English translation).
Chinese Office Action dated Oct. 27, 2010 issued in Application No. 200610168848.0 (with English translation).
Chinese Office Action dated Nov. 9, 2010 issued in Application No. 200610169333.2 (with English translation).
U.S. Notice of Allowance dated Jan. 12, 2011 issued in U.S. Appl. No. 11/965,133.
Japanese Office Action dated Apr. 7, 2011. (2010-005365).
U.S. Office Action issued in U.S. Appl. No. 12/407,983 dated Jun. 21, 2011.
Korean Office Action dated Sep. 17, 2010 issued in Application No. 10-2008-0065806.
U.S. Office Action dated Nov. 3, 2010 issued in U.S. Appl. No. 12/710,585.
U.S. Final Office Action dated Nov. 8, 2010 issued in U.S. Appl. No. 12/406,803.
U.S. Office Action dated Nov. 12, 2010 issued in U.S. Appl. No. 12/704,933.
U.S. Office Action issued in U.S. Appl. No. 12/406,779 dated Feb. 3, 2011.
U.S. Office Action issued in U.S. Appl. No. 11/831,473 dated Feb. 4, 2011.
U.S. Office Action issued in U.S. Appl. No. 12/408,066 dated Feb. 10, 2011.
U.S. Office Action issued in U.S. Appl. No. 12/710,585 dated Feb. 10, 2011.
U.S. Office Action issued in U.S. Appl. No. 12/404,739 dated Feb. 18, 2011.
U.S. Office Action issued in U.S. Appl. No. 12/404,692 dated Mar. 9, 2011.
U.S. Office Action issued in U.S. Appl. No. 12/404,715 dated Mar. 9, 2011.
U.S. Notice of Allowance issued in U.S. Appl. No. 12/408,066 dated Mar. 21, 2011.
U.S. Notice of Allowance issued in U.S. Appl. No. 12/407,224 dated Mar. 28, 2011.
Japanese Office Action dated Jan. 4, 2011. (Application No. 2006-333685).
European Search Report dated Jan. 27, 2011. (Application No. 06125798.6-2316/1852048).
Russian Office Action dated Feb. 2, 2011 (Application No. 2009143355) (with translation).
Korean Notice of Allowance dated Aug. 28, 2008. (KR10-2006-0018119).
Korean Notice of Allowance dated Aug. 28, 2008. (KR10-2006-0046077).
Korean Office Action dated Aug. 29, 2008. (KR10-2006-0085919).
Korean Notice of Allowance dated Sep. 26, 2008. (KR10-2006-0085921).
Korean Notice of Allowance dated Feb. 16, 2009. (KR10-2006-0045415).
Korean Notice of Allowance dated Apr. 28, 2009. (KR10-2006-0045416).
European Search Report dated Mar. 19, 2012.
U.S. Office Action issued in U.S. Appl. No. 12/407,243 dated Apr. 6, 2012.
U.S. Notice of Allowance issued in U.S. Appl. No. 12/404,715 dated Apr. 26, 2012.
Russian Office Action dated Sep. 28, 2007 issued in Application No. 2007103559 (translation only).
Russian Office Action dated Oct. 1, 2007 issued in Application No. 2007103555 (translation).
Russian Office Action dated Oct. 10, 2007 issued in Application No. 2007103557.
U.S. Office Action dated Feb. 11, 2008 issued in U.S. Appl. No. 11/831,473.
U.S. Office Action dated Feb. 11, 2008 issued in U.S. Appl. No. 11/831,564.
Korean Office Action dated Mar. 25, 2008. issued in Application No. 10-2007-0007359 (016285635).
Australian Office Action dated Apr. 15, 2008 issued in Application No. 2007200407.
Australian Office Action dated Apr. 17, 2008 issued in Application No. 2007200408.
Russian Office Action dated Apr. 21, 2008 issued in Application No. 2007103560 (with translation).
Australian Office Action dated Apr. 24, 2008 issued in Application No. 2007200409.
European Office Action dated May 8, 2008 issued in Application No. 07 101 388.2-2316.
Australian Office Action dated Jun. 3, 2008 issued in Application No. 2006249267.
U.S. Final Office Action dated Jul. 24, 2008 issued in U.S. Appl. No. 11/831,473.
U.S. Office Action dated Jul. 28, 2008 issued in U.S. Appl. No. 11/712,958.
U.S. Office Action dated Aug. 28, 2008 issued in U.S. Appl. No. 11/713,022.
Korean Office Action dated Aug. 29, 2008 issued in Application No. 10-2006-0045415.
Japanese Office Action dated Sep. 18, 2008 issued in Application No. 2006-332005.
U.S. Office Action dated Sep. 19, 2008 issued in U.S. Appl. No. 11/831,564.
Korean Office Action dated Sep. 30, 2008 issued in Application No. 10-2007-007359 (050567614).
U.S. Office Action dated Oct. 20, 2008 issued in U.S. Appl. No. 11/831,473.
Japanese Office Action dated Nov. 6, 2008 issued in Application No. 2006-333685.

International Search Report and Written Opinion dated Dec. 10, 2008 issued in Application No. PCT/KR2008/004849.
Chinese Office Action dated Dec. 12, 2008 issued in Application No. 200710002992.1 (translation).
Japanese Office Action dated Dec. 24, 2008 issued in Application No. 2006-333719.
Chinese Office Action dated Feb. 6, 2009 issued in Application No. 200710085701X.
U.S. Final Office Action dated Mar. 9, 2009 issued in U.S. Appl. No. 11/713,022.
Japanese Office Action dated Mar. 12, 2009 issued in Application No. 2007-019770.
Japanese Office Action dated Mar. 12, 2009 issued in Application No. 2007-019861.
Japanese Office Action dated Mar. 13, 2009 issued in Application No. 2007-021083.
Russian Office Action dated Mar. 25, 2009 issued in Application No. 2008102660 (with translation).
Chinese Office Action dated Apr. 3, 2009 issued in Application No. 200710002990.2 (with translation).
Australian Office Action dated Apr. 16, 2009 issued in Application No. 2008200340.
Chinese Office Action dated May 8, 2009 issued in Application No. 200610153199.7 (translation).
U.S. Office Action dated May 13, 2009 issued in U.S. Appl. No. 11/965,133.
Chinese Office Action dated May 22, 2009 issued in Application No. 200710002292.1 (translation).
Japanese Office Action dated May 22, 2009 issued in Application No. 2006-333719.
U.S. Final Office Action dated May 28, 2009 issued in U.S. Appl. No. 11/831,473.
Chinese Office Action dated Jun. 5, 2009 issued in Application No. 200610169333.2 (translation).
European Search Report dated Jun. 16, 2009 issued in Application No. 06 12 5823 (in English).
Korean Office Action dated Jun. 19, 2009 issued in Application No. 10-2007-0071137.
Chinese Office Action dated Jul. 3, 2009 issued in Application No. 200610168848.0 (with translation).
Japanese Office Action dated Jul. 28, 2009 issued in Application No. 2007-066748.
Chinese Office Action dated Aug. 21, 2009 issued in Application No. 200710002991.7 (with translation).
Chinese Office Action dated Aug. 21, 2009 issued in Application No. 200810008716.0 (with translation).
U.S. Office Action dated Sep. 3, 2009 issued in U.S. Appl. No. 11/831,564.
U.S. Office Action dated Sep. 10, 2009 issued in U.S. Appl. No. 11/565,241.
U.S. Office Action dated Oct. 6, 2009 issued in U.S. Appl. No. 12/406,803.
European Search Report dated Oct. 15, 2009 issued in Application No. 06 12 5560.0-2316.
Japanese Office Action dated Nov. 4, 2009 issued in Application No. 2007-019770 (with translation).
Chinese Office Action dated Nov. 13, 2009 issued in Application No. 200710085701.X (with translation).
Canadian Office Action dated Nov. 18, 2009 issued in Application No. 2,598,113.
Canadian Office Action dated Nov. 18, 2009 issued in Application No. 2,598,117.
Japanese Office Action dated Nov. 25, 2009 issued in Application No. 2007-019861.
Japanese Office Action dated Nov. 25, 2009 issued in Application No. 2007-021083.
Japanese Office Action dated Nov. 25, 2009 issued in Application No. 2007-066748.
Chinese Office Action dated Dec. 11, 2009 issued in Application No. 200710002992.1 (with translation).
U.S. Notice of Allowance dated Jan. 13, 2010 issued in Application No. 11/965,133.
European Search Report dated Jan. 20, 2010 issued in Application No. 06 12 5560.
Chinese Office Action dated Feb. 5, 2010 issued in Application No. 200710002991.7 (with translation).
U.S. Notice of Allowance dated Feb. 19, 2010 issued in U.S. Appl. No. 11/565,241.
U.S. Notice of Allowance dated Feb. 24, 2010 issued in U.S. Appl. No. 11/831,564.
Korean Office Action dated Mar. 18, 2010 issued in Application No. 10-2008-0065806.
Korean Office Action dated Mar. 25, 2010 issued in Application No. 10-2008-0065807.
U.S. Office Action dated Apr. 19, 2010 issued in U.S. Appl. No. 11/565,206.
U.S. Notice of Allowance dated Apr. 21, 2010 issued in U.S. Appl. No. 11/831,519.
Japanese Office Action dated May 13, 2010 issued in Application No. 2007-019861.
U.S. Office Action dated May 14, 2010 issued in U.S. Appl. No. 11/831,473.
U.S. Office Action dated May 26, 2010 issued in U.S. Appl. No. 12/406,803.
Canadian Office Action dated Jun. 30, 2010 issued in Application No. 2,598,113.
U.S. Office Action dated Jul. 9, 2010 issued in U.S. Appl. No. 11/965,133.
U.S. Office Action dated Jul. 23, 2010 issued in U.S. Appl. No. 12/408,066.
Japanese Office Action dated Aug. 3, 2010 issued in Application No. 2006-333685 (2009-11705).
U.S. Office Action dated Aug. 18, 2010 issued in U.S. Appl. No. 12/406,779.
U.S. Office Action dated Sep. 1, 2010 issued in U.S. Appl. No. 11/831,473.
U.S. Notice of Allowance dated Oct. 1, 2010 issued in U.S. Appl. No. 11/565,206.
U.S. Office Action issued in U.S. Appl. No. 12/407,243 dated Sep. 19, 2012.
U.S. Office Action issued in U.S. Appl. No. 12/720,160 dated Dec. 4, 2012.
U.S. Office Action issued in U.S. Appl. No. 12/407,243 dated Nov. 16, 2011.
U.S. Office Action issued in U.S. Appl. No. 12/404,692 dated Dec. 7, 2011.
U.S. Office Action issued in U.S. Appl. No. 12/404,715 dated Dec. 8, 2011.
U.S. Notice of Allowance issued in U.S. Appl. No. 12/710,585 dated Dec. 30, 2011.
U.S. Office Action issued in U.S. Appl. No. 12/407,975 dated Jan. 30, 2012.
U.S. Office Action issued in U.S. Appl. No. 12/704,901 dated Mar. 25, 2013.

* cited by examiner

VACUUM CLEANER

This application claims the benefit of U.S. Provisional Patent Application No. 61/151,982, filed on Feb. 12, 2009, which is hereby incorporated by reference in its entirety.

BACKGROUND

1. Field

A vacuum cleaner is disclosed herein.

2. Background

Vacuum cleaners are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

In the following detailed description, reference is made to the accompanying drawings that form a part hereof, and in which is shown by way of illustration specific embodiments. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the invention is defined only by the appended claims.

Generally, vacuum cleaners are devices that suck in air containing dust using a suction force generated by a suction motor installed inside a main body to filter the dust in a dust separator. Such a vacuum cleaner may be classified as a canister type, in which a suction nozzle that sucks in dust is separately provided from a main body and connected to the main body using a connection device, and an upright type, in which a suction nozzle is rotatably connected to a main body.

A related art vacuum cleaner may include a main body and a dust separator installed on or in the main body to store dust separated from air. The dust separator may be configured to separate the dust from the air using a cyclone principle. Thus, the dust separator may include a dust separation chamber. Also, the dust separator may include a filter member that filters the air separated from the dust in the dust separation chamber. The performance of the vacuum cleaner may be substantially determined according to a degree of dust separation performance.

Figure 1:
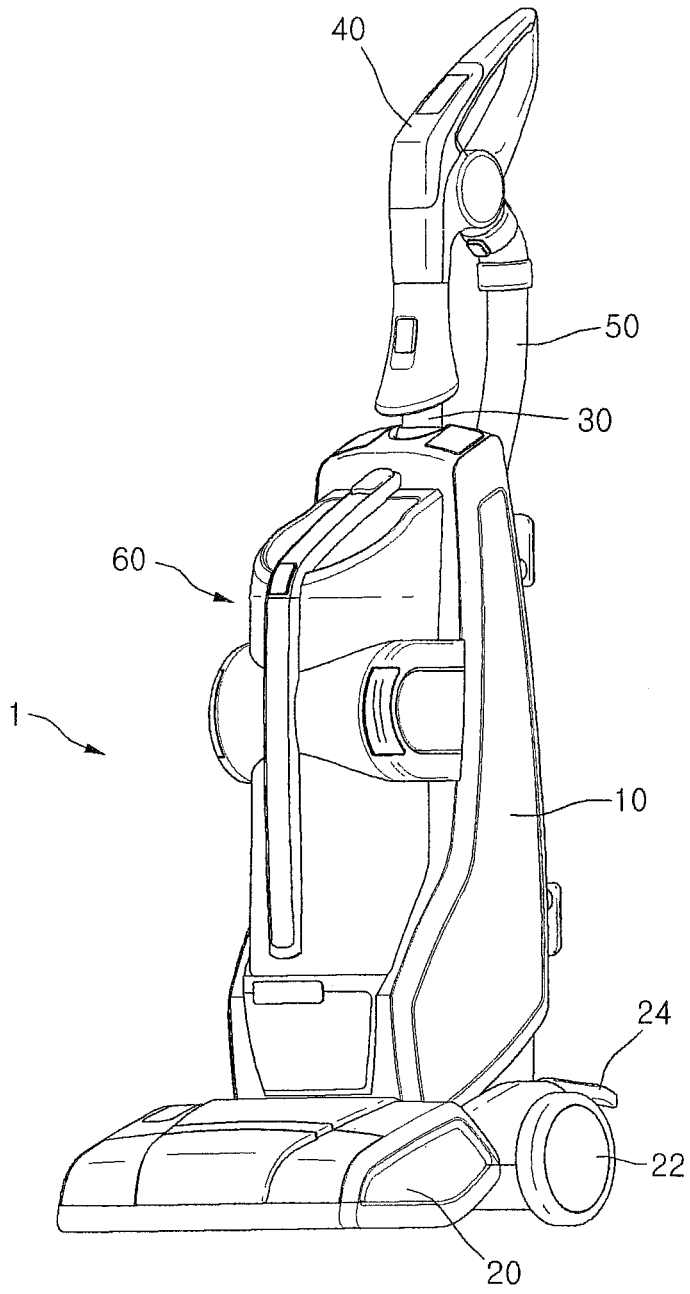
FIG. 1 is a perspective view of a vacuum cleaner according to an embodiment.
Figure 2:
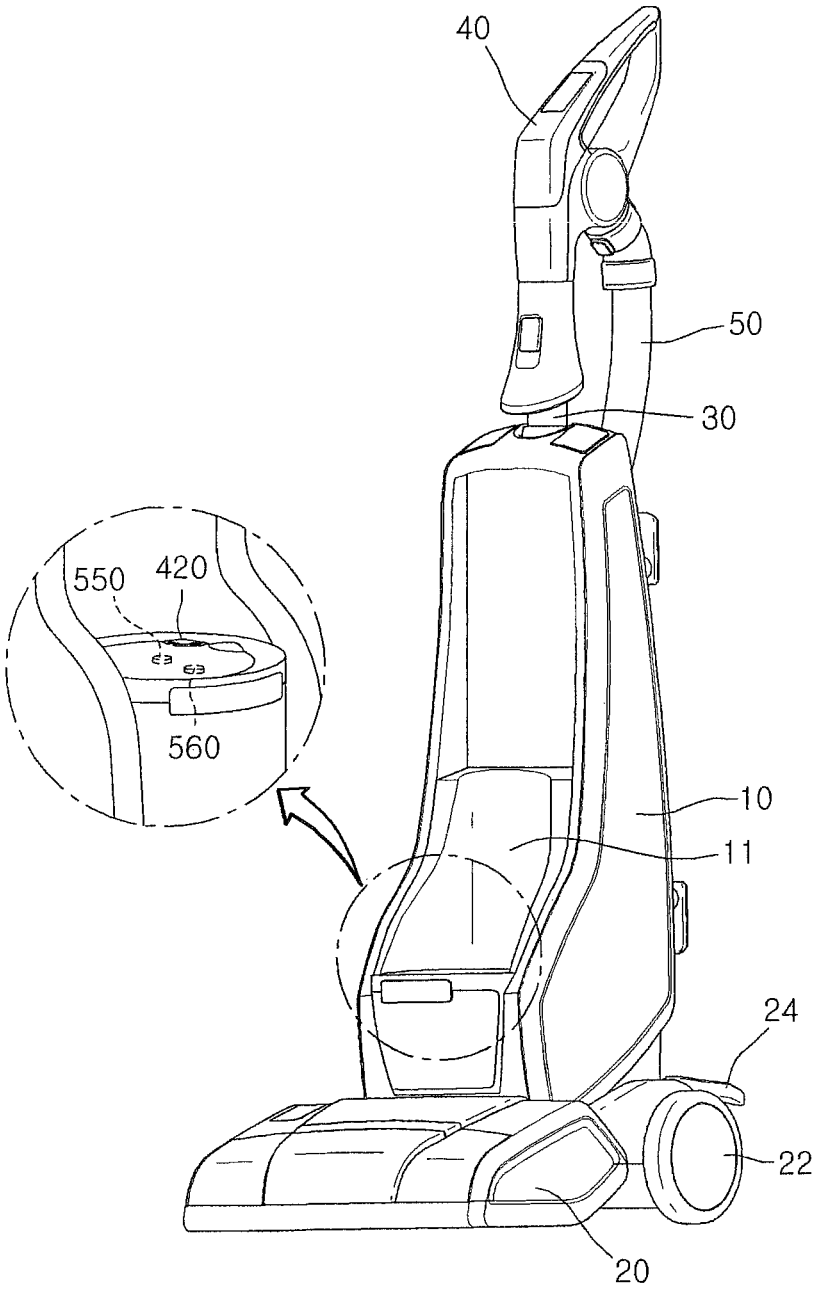
FIG. 2 is a perspective view of the vacuum cleaner of FIG. 1 showing a dust separator separated therefrom.

FIG. 1 is a perspective view of a vacuum cleaner according to an embodiment, and FIG. 2 is a perspective view of the vacuum cleaner of FIG. 1 in a state in which a dust separator is separated therefrom. Although this embodiment shows a dust separator installed in an upright type vacuum cleaner; however, embodiments are not limited thereto. For example, the dust separator may be installed in a canister type vacuum cleaner.

Referring to FIGS. 1 and 2, a vacuum cleaner 1 according to this embodiment may include a main body 10, a suction nozzle 20, a dust separator 60, a suction tube 30, a handle 40, and a connection hose 50. A suction motor (not shown) that generates a suction force may be disposed in the main body 10. The suction nozzle 20 may be rotatably connected to a lower portion of the main body 10 and disposed on a floor or other surface. The dust separator 60 may be separably mounted on the main body 10. The suction tube 30 may be separably mounted on the main body 10. The handle 40 may be connected to the suction tube 30. The connection hose 50 may connect the handle 40 to the main body 10. Further, wheels 20 may be disposed on both sides of the suction nozzle 20 to allow a user to easily move the suction nozzle 20.

An operating lever 24 may be disposed on a rear side of the suction nozzle 20, so that the main body 10 may be rotated with respect to the suction nozzle 20 in an upright state. When the operating lever 24 is operated, the main body 10 may be rotated with respect to the suction nozzle 20. Then, a user may grasp the handle 40 in order to clean the floor or other surface while moving the suction nozzle 20.

The dust separator 60 may be separably mounted to a mounting part 11, which may be disposed at a front portion of the main body 10. The suction tube 30 may be separably mounted on a rear portion of the main body 10. The dust separator 60 may separate dust from air sucked into the main body 10 and store the separated dust.

The mounting part 11 may include a first detector 550 that detects mounting of the dust separator 60, and a second detector 560 that detects an amount of dust stored in the dust separator 60. The detectors 550 and 560 will be described hereinafter.

Figure 3:
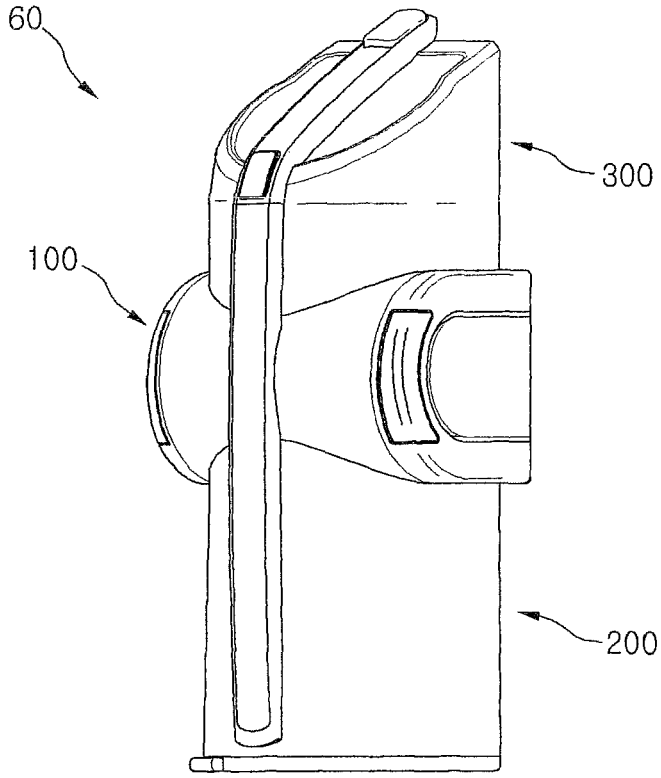
FIG. 3 is a perspective view of the dust separator according to the embodiment of FIG. 1.
Figure 4:
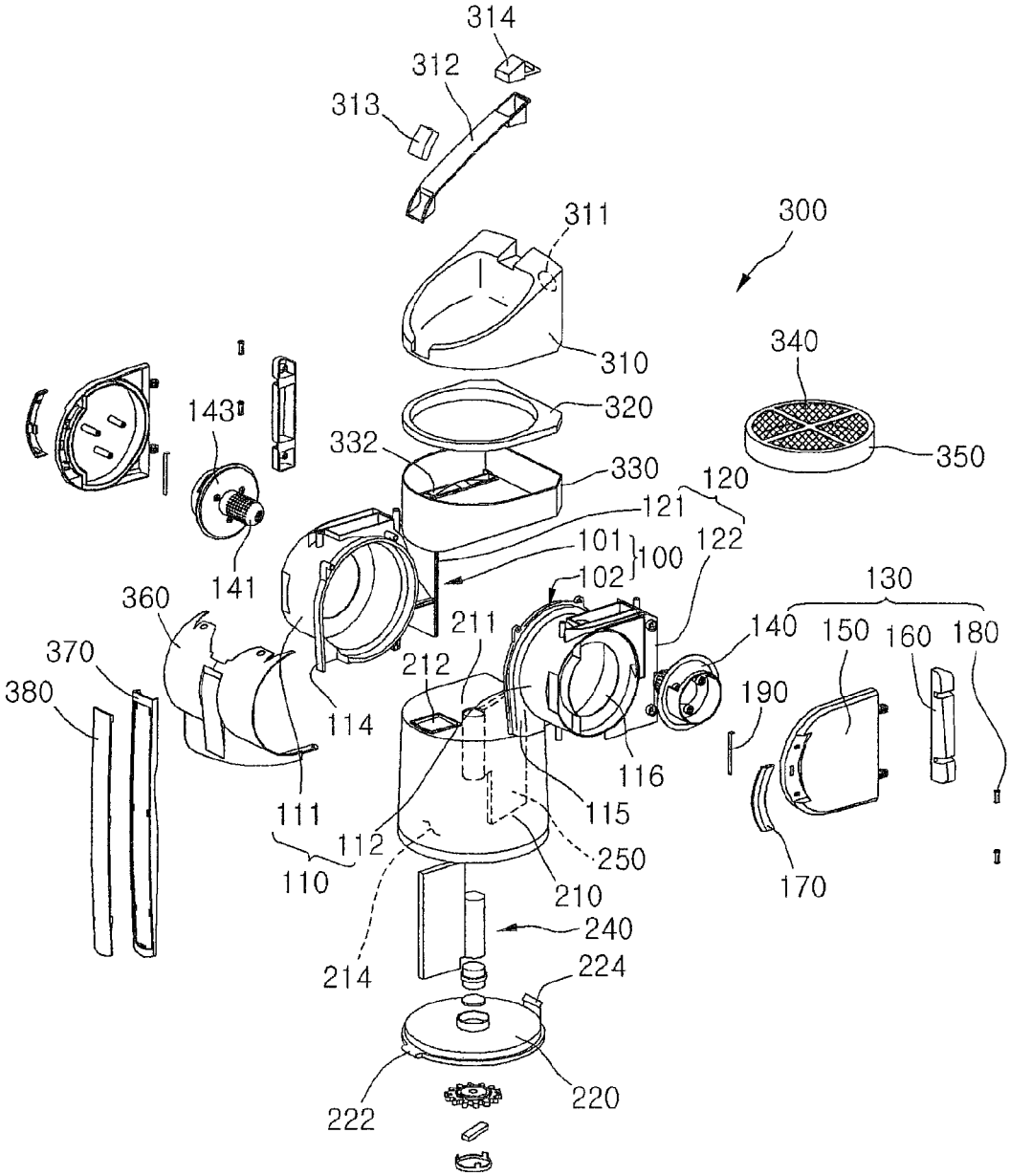
FIG. 4 is an exploded perspective view of the dust separator according to the embodiment of FIG. 1.
Figure 5:
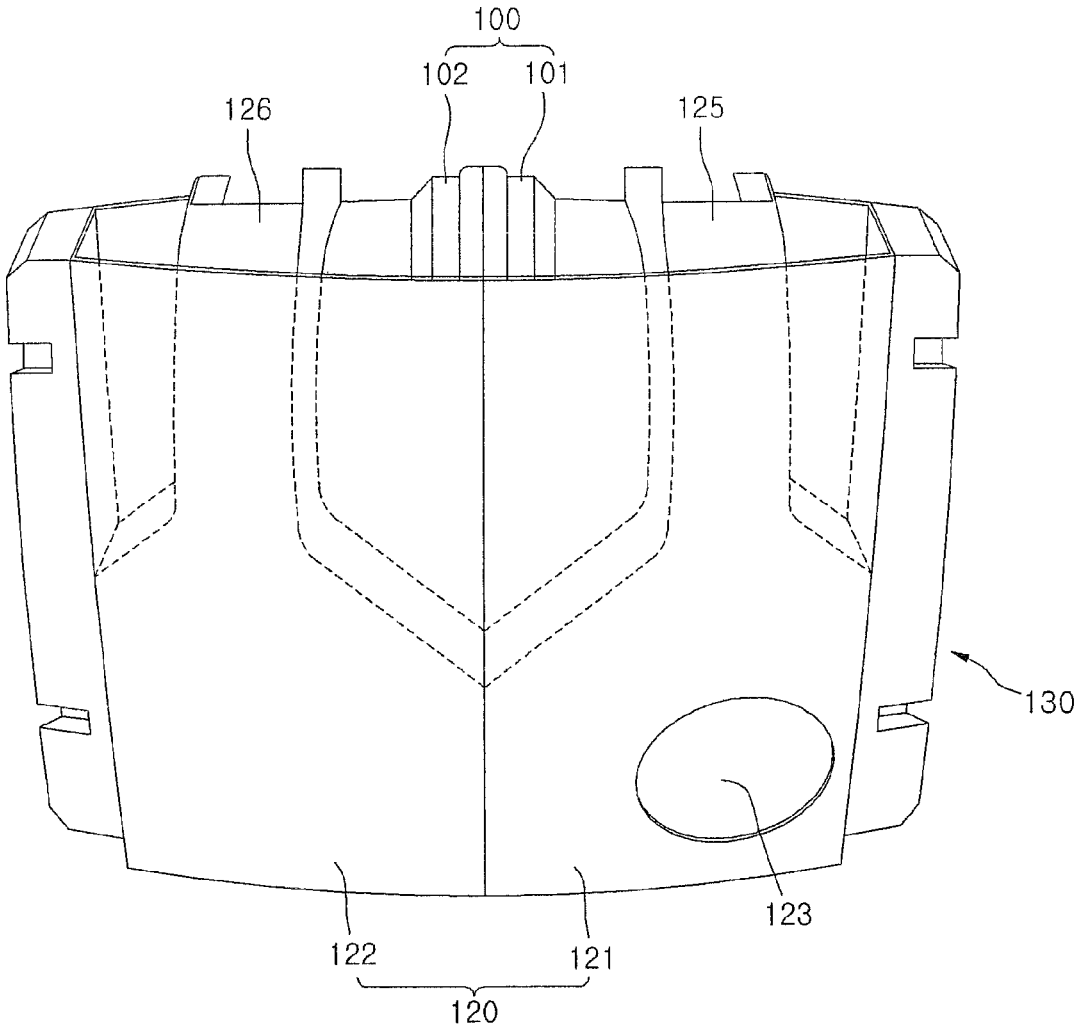
FIG. 5 is a perspective view of a dust separation device according to the embodiment of FIG. 1.

Hereinafter, a structure of the dust separator 60 will be described in more detail. FIG. 3 is a perspective view of the dust separator according to the embodiment of FIG. 1. FIG. 4 is an exploded perspective view of the dust separator according to the embodiment of FIG. 1. FIG. 5 is a perspective view of a dust separation device according to the embodiment of FIG. 1.

Referring to FIGS. 3 to 5, the dust separator 60 may include a dust separation device 100 that separates dust from sucked sir, a dust container 200 in which the dust separated by the dust separation device 100 is stored, and an exhaust guide device 300 that guides an airflow of the air exhausted from the dust separation device 100. The dust separation device 100 may be coupled to an upper side of the dust container 200 and a lower side of the exhaust guide device 300.

A deco cover 360 may be coupled to the dust separation device 100. An inner deco 370 and an outer deco 380 may be coupled to the deco cover 360 and the dust container 200 in a state in which the dust container 200 is coupled to the dust separation device 100. The deco cover 360, the inner deco 370, and the outer deco 380 may improve an outer appearance of the dust separator 60.

The dust separation device 100 may include a cyclone device 110 that separates the dust from the air, a distribution device 120 that guides the air and the dust to the cyclone device 110, and a plurality of filter devices 130, which may be rotatably coupled to the cyclone device 110, that filters the air from which the dust is separated.

The respective filter devices 130 may include a filter member 140, a cover member 150, a cover coupling part 160, a coupling member 170, an elastic member 190, and a shaft 180. The filter member 140 may be inserted into the cyclone device 110 from outside of the cyclone device 110. The cover member 150 may be coupled to the filter member 140. The cover coupling part 160 may be coupled to the cover member 150 to rotatably support the cover member 150. The coupling member 170 may be coupled to the cover member 150 to operate rotation of the cover member 150. The elastic member 190 may elastically support the coupling member 170. The shaft 180 may allow the cover member 150 to be rotatably connected to the cover coupling part 160.

The cover coupling part 160 may be coupled to the distribution device 120. Alternatively, the cover coupling part 160 may be integrated with the distribution device 120.

The filter member 140 may include a filter body 141 and an opening cover 143 that extends from an outer circumference of the filter body 141. The filter body 141 may selectively pass through an exhaust opening 116 defined in the cyclone device 110, and the opening cover 143 may selectively open and close the exhaust opening 116.

The dust container 200 may include a dust collector body 210, in which a dust storage part 214 may be disposed, and a lower cover 220 that covers a lower side of the dust collector body 210. For example, the dust collector body 210 may have a cylindrical shape and an open lower side; however, embodiment are not limited thereto.

A dust inlet 212, through which dust discharged from the dust separation device 100 may be introduced, may be defined in a top surface 211 of the dust collector body 210. Since the dust collector body 210 may be coupled to a lower portion of the dust separation device 100 and the dust inlet 212 defined in the top surface 211 of the dust collector body 210, the dust discharged from the dust separation device 100 may drop into the duct collection body 210.

The lower cover 220 may have one side connected to the dust collector body 210 by, for example, a hinge 222, and the other side selectively coupled to the dust collector body 210 by, for example, a coupling hook 224. When the lower cover 220 is rotated to open a lower opening of the dust collector body 210, the dust within the dust collector body 210 may be easily discharged.

A plurality of compression members 240 and 250 that compress the dust stored in the dust storage part 214 may be disposed in the dust collector body 210. The plurality of compression members 240 and 250 may include a first compression member 240 movably disposed in the dust storage part 214 and a second compression member 250 fixed to the dust storage part 214. In this embodiment, the first compression member 240 may be referred to as a moveable member, and the second compression member 250 may be referred to as a fixed member. The compression members 240 and 250 will be described in more detail later with reference to accompanying drawings.

The exhaust guide device 300 may include an exhaust member 330, an exhaust filter 340, a filter housing 350, a filter seat guide 320, and an upper cover 310. The exhaust member 330 may be coupled to an upper portion of the dust separation device 100. The exhaust filter 340 may be seated on the exhaust member 330 to filter the exhausted air. The filter housing 350 may protect the exhaust filter 340. The filter seat guide 320 may guide seating of the filter housing 350, to which the exhaust filter 340 may be coupled, and may be coupled to the exhaust member 330. The upper cover 310 may be rotatably coupled to an upper portion of the exhaust member 330.

An air exhaust hole 311 that exhausts air may be defined in the upper cover 310. Air passing through the air exhaust hole 311 may be moved into the main body 10.

A handle part 312 may be disposed on the upper cover 310 to allow a user to easily grasp the upper cover 310. The handle part 312 may include a first coupling button 313 that fixes a position of the upper cover 310 and a second coupling button 314 coupled to the main body 10. The first coupling button 313 may be selectively coupled to the inner deco 370.

An exhaust passage 332, through which the air exhausted from the dust separation device 100 may flow, may be defined in the exhaust member 330. The air exhausted through the exhaust passage 332 may pass through the exhaust filter 340, and may then be exhausted through the air exhaust hole 311.

Hereinafter, a structure of each of component of the dust separation device 100 will be described in more detail.

Figure 6:
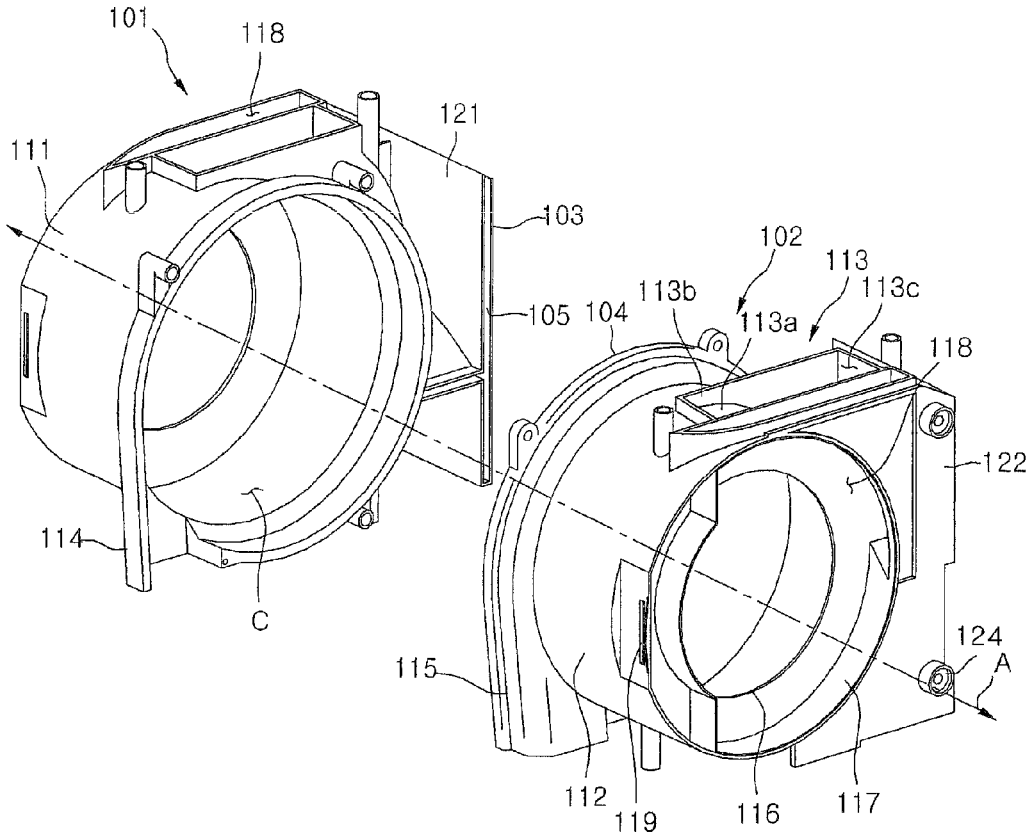
FIG. 6 is a partially exploded perspective view of the dust separation device according to the embodiment of FIG. 1.

FIG. 6 is a partially exploded perspective view of the dust separation device according to the embodiment of FIG. 6. Referring to FIGS. 4 to 6, the dust separation device 100 may include a first dust separator body 101 and a second dust separator body 102, which may be coupled to each other. The first dust separator body 101 may include a first cyclone body 111 that generates a first cyclone flow and a first distribution body 121, which may be integrated with the first cyclone body 111, that guides air to the first cyclone body 111. The second dust separator body 102 may include a second cyclone body 112 that generates a second cyclone flow and a second distribution body 122, which may be integrated with the second cyclone body 112, that guides air to the second cyclone body 112. The first cyclone body 111 and the second cyclone body 112 may constitute the cyclone device 110, and the first distribution body 121 and the second distribution body 122 may constitute the distribution device 120.

The respective cyclone bodies 111 and 112 may each include an air suction part 113. Thus, the cyclone device 110 may include a plurality of air suction parts 113.

A first dust discharge part 114 may be integrated with the first cyclone body 111, and a second dust discharge part 115 may be integrated with the second cyclone body 112. When the first cyclone body 111 and the second cyclone body 112 are coupled to each other, the first dust discharge part 114 and the second dust discharge part 115 may be coupled to each other to form a singular dust discharge part.

The singular dust discharge part may define a singular dust discharge passage. The respective dust discharge parts 114 and 115 may extend from the respective cyclone bodies 111 and 112 in a direction inclined to a cyclone flow axis (see reference symbol A of FIG. 6). The dust discharge parts 114 and 115 may be disposed at a central position of the cyclone device 110, and the air suction part 113 may be disposed on each of both sides of the dust discharge parts 114 and 115.

A suction hole 123 may be defined in any one of the first and second distribution bodies 121 and 122. A structure in which the suction hole 123 is defined in the first distribution body 121 is illustrated in FIG. 5 as an example.

The respective distribution bodies 121 and 122 may include flow guides 125 and 126 that guide air sucked in through the suction hole 123, such that the air flows toward the air suction part 113. That is, the air sucked into the distribution device 120 through the suction hole 123 may be branched to flow along the respective flow guides 125 and 126, and then may be moved to the respective air suction part 113.

One or more coupling boss(es) 124 coupled to the cover coupling part 160 may be disposed on a side surface of each of the distribution bodies 121 and 122. Further, at least portion of the respective cyclone bodies 111 and 112 may have, for example, a cylindrical or conic shape to generate a cyclone flow.

The first dust separator body 101 may have a first coupling surface 103, and the second dust separator body 102 may have a second coupling surface 104 that faces the first coupling surface 103. The exhaust opening 116 of the respective dust separator bodies 101 and 102 may be defined in a surface opposite to each of the respective coupling surfaces 103 and 104. Further, the first dust separator body 101 and the second dust separator body 102 may be coupled to each other in a direction of a cyclone flow axis A (or in a direction parallel to each other). That is, the first coupling surface 103 and the second coupling surface 104 may be inclined to the cyclone flow axis A, for example, substantially perpendicular to the cyclone flow axis A, and thus, the first coupling surface 103 and the second coupling surface 104 may be closely attached to each other in the direction of the cyclone flow axis A.

As described above, since the two dust separator bodies 101 and 102 may be coupled to each other in the direction of the cyclone flow axis A, the dust separation device 100 may be easily manufactured, and also, manufacturing costs may be reduced. In addition, a number of components may be reduced.

That is, when comparing manufacture of one complete dust separation device, in a case in which the dust separation bodies 101 and 102 having the same configuration as each other are separately manufactured, a number of molds for manufacturing the respective dust separation bodies 101 and 102 may be reduced, and also mold structures may be simplified. Thus, the dust separation device 100 may be easily manufactured, and costs for manufacturing the dust separation device 100 may be reduced. Also, since the respective dust separator bodies 101 and 102 may include the cyclone bodies 111 and 112 and the distribution bodies 121 and 122, a separate distribution body may not be required reducing the number of components.

A seat part 105 configured to seat a sealer (see reference symbol S in FIG. 9) may be disposed on any one of the first coupling surface 103 and the second coupling surface 104. A structure, in which the seat part 105 may be disposed on the first coupling surface 103 is illustrated in FIG. 6, as an example.

As described above, since the plurality of dust separator bodies 101 and 102 may be coupled to each other in the direction of the cyclone flow axis, an area for sealing and/or a length of the sealer may be reduced. That is, when compared to the case in which the plurality of dust separator bodies are coupled to each other in a direction perpendicular to the cyclone flow axis, in a case in which the plurality of dust separator bodies are coupled to each other in the direction of the cyclone flow axis, a contact area of the respective dust separator bodies 101 and 102 may be reduced, and also, the area for sealing and/or the length of the sealer may be reduced.

Also, since the singular dust discharge part may be disposed in the dust separation device, a structure of the dust separation device may be simplified. In addition, when compared to a case in which a plurality of dust discharge parts is disposed in the dust separation device, space utilization may be increased.

When the first cyclone body 111 and the second cyclone body 112 are coupled to each other, a singular cyclone chamber C may be defined. That is, the first cyclone body 111 may define one portion of the cyclone chamber C, and the second cyclone body 112 may define the other portion of the cyclone chamber C.

The air suction part 113 may include a suction opening 113*a* that passes through the respective cyclone bodies 111 and 112 and a suction guide 113*b* that protrudes from the respective cyclone bodies 111 and 112. The suction guide 113*b* may define a lateral surface of a suction passage 113*c* that communicates with the distribution device 120. The suction passage 113*c* may be covered by the exhaust member 330 coupled to an upper portion of the dust separation device 100.

The exhaust opening 116, through which air may be exhausted, may be defined in a lateral surface of the respective cyclone bodies 111 and 112. An exhaust guide 117 that guides the air exhausted through the exhaust opening 116 may be disposed outside of the lateral surface of the respective cyclone bodies 111 and 112. The exhaust guide 117 and the respective distribution bodies 121 and 122 may define an air exhaust passage 118. The air exhaust passage 118 may communicate with the exhaust passage 332 of the exhaust member 330.

A coupling part 119, which may be coupled to a coupling hook (see reference numeral 172 of FIG. 12) of a coupling member, will be described later and may be disposed on the respective cyclone bodies 111 and 112.

Figure 7:
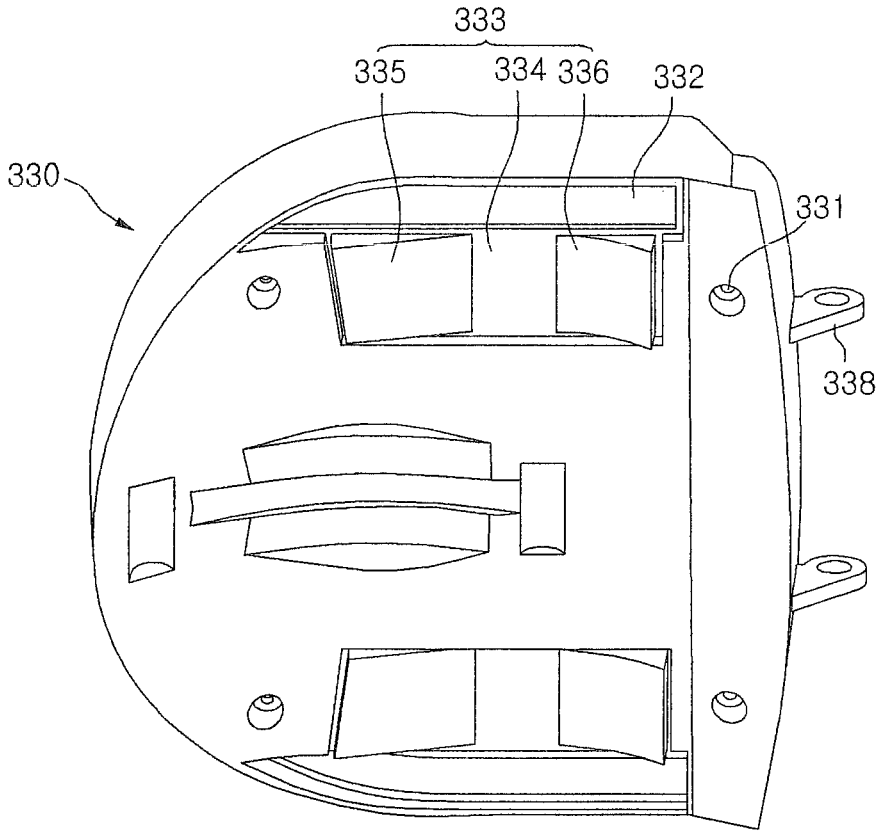
FIG. 7 is a perspective view illustrating a lower side of an exhaust member according to the embodiment of FIG. 1.
Figure 8:
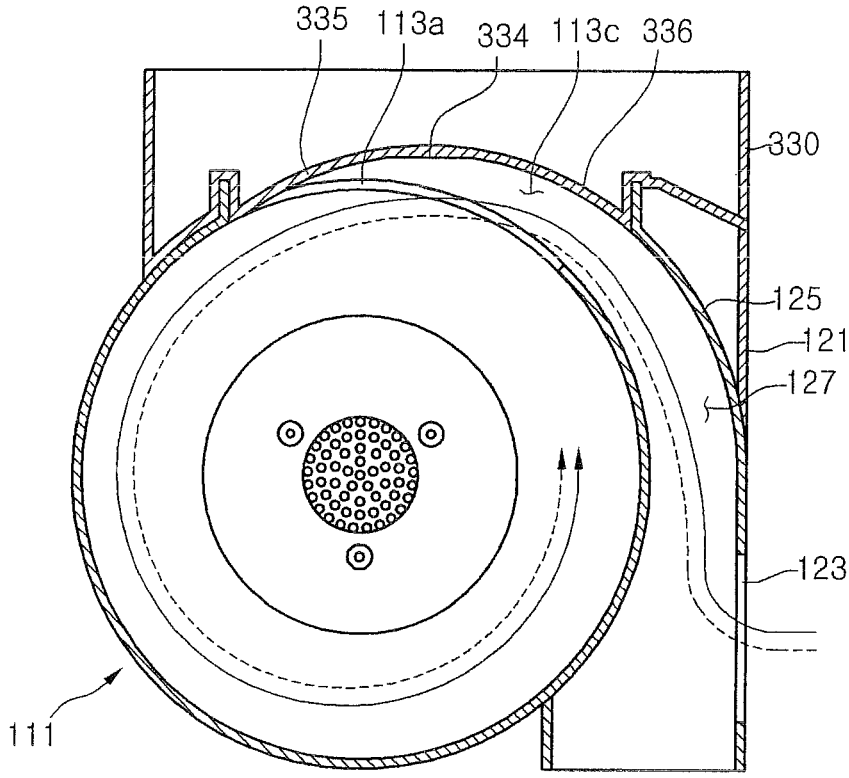
FIG. 8 is a sectional view showing the exhaust member of FIG. 7 coupled to the dust separation device.

FIG. 7 is a perspective view illustrating a lower side of an exhaust member according to the embodiment of FIG. 1, and FIG. 8 is a sectional view of a state in which the exhaust member of FIG. 7 is coupled to the dust separation device. A vertical sectional view of the first dust separator body is illustrated in FIG. 8, as an example. Since the first dust separator body and the second dust separator body may have the same configuration, the configuration of only the first dust separator body will be described herein below.

Referring to FIGS. 5 to 8, a plurality of coupling holes 331, through which a coupling member coupled to the dust separation device 100 may pass, may be defined in the exhaust member 330. A hinge part 338, which may be coupled to the upper cover 310, may be disposed on a rear side of the exhaust member 330.

Further, a plurality of exhaust passages 332, through which the air within the air exhaust passage 118 may pass, may be defined in the exhaust member 330. A passage formation part 333 that defines a portion of the suction passage 113*c* may be disposed between the plurality of exhaust passages 332. The passage formation part 333 may define a top surface of the suction passage 113*c*.

The passage formation part 333 may include a middle portion 334, a first guide portion 335 disposed at a rear side of the middle portion 334 with respect to an air suction direction, and a second guide portion 336 disposed at a front side of the middle portion 334 with respect to the air suction direction. That is, air may sequentially flow along the second guide portion 336, the middle portion 334, and the first guide portion 335, and then may be introduced into the cyclone chamber C through the suction opening 113*a*. The passage formation part 333 may have, for example, a rounded shape as a whole, or at least one surface of the passage formation part 333 may be flat.

As shown in FIG. 8, the flow guide 125 of the first distribution body 121 and an outer surface of the first cyclone body 111 may define a connection passage 127, through which the suction hole 123 may communicate with the suction passage 113*c*. Thus, at least a portion of the air sucked through the suction hole 123 may flow along the outer surface of the first cyclone body 111.

A bottom surface of the passage formation part 333, an inner surface of the flow guide 125, and an inner circumference of the cyclone chamber C may form a continuously curved surface in a state in which the exhaust member 330 is coupled to the dust separation device 100, such that air and dust smoothly flow along the insides of the connection passage 127 and the suction passage 113*c*. Thus, since the air and dust flow along the inner surface of the flow guide 125 and the bottom surface of the passage formation part 333, and then the air and dust flow along the inner circumference of the cyclone chamber C, cyclone flow may be easily generated within the cyclone chamber C. That is, since the air and dust flow into the cyclone chamber C in a state in which a centrifugal force is applied to the air and dust flowing along the inner surface of the flow guide 125 and the bottom surface of the passage formation part 333, the air and dust may smoothly flow along the inner circumference of the cyclone chamber C.

In this embodiment, since the connection passage 127 and the suction passage 113*c* guide the air and dust to the suction opening 113*a*, the connection passage 127 and the suction passage 113*c* may be called guide passages, respectively. Thus, the passage formation part 333 may define a portion of the guide passage.

Hereinafter, an effect of the dust separator according to this embodiment will be described.

Figure 9:
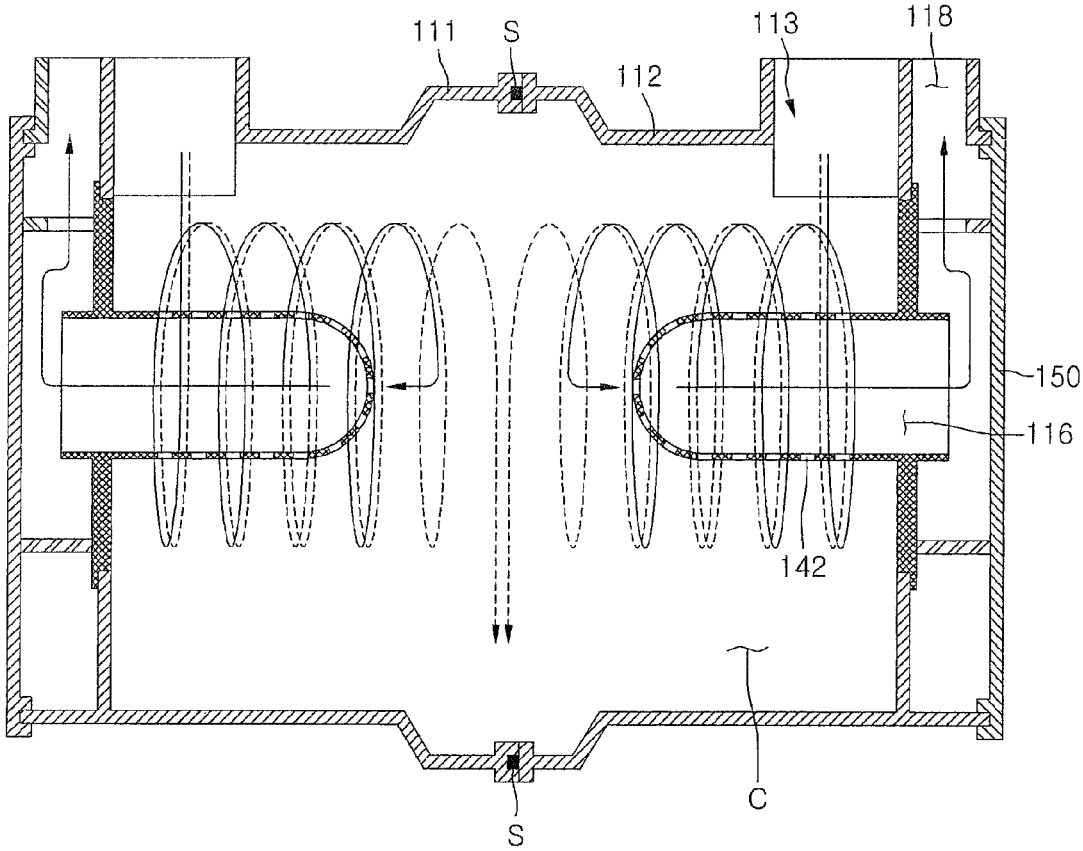
FIG. 9 is a sectional view illustrating an airflow within the dust separation device according to the embodiment of FIG. 1.

FIG. 9 is a sectional view illustrating an airflow within the dust separation device according to the embodiment of FIG. 1. Referring to FIGS. 1 to 9, when a suction force is generated by the suction motor disposed within the main body 10, air containing dust may be sucked through the suction nozzle 20. The sucked air may be introduced into the main body 10, and then exhausted to the dust separator 60.

The air exhausted from the main body 10 may be sucked into the distribution device 120 through the suction hole 123. The air sucked into the distribution device 120 may be branched into each of the connection passages 127, and then sucked into the cyclone device 110 through the respective suction openings 113*a*.

Thus, a plurality of cyclone flows may be generated within the singular cyclone chamber C disposed within the cyclone device 110. That is, a first cyclone flow may be generated within the first cyclone body 111, and a second cyclone flow may be generated within the second cyclone body 112.

The sucked air circularly may flow along the inner circumference of the cyclone device 110 and may be concentrated at a central portion of the cyclone device 110. With this process, the air and dust may be separated from each other because different centrifugal forces may be respectively applied to the air and dust due to weight difference.

As described above, since the plurality of cyclone flows may be generated within the singular cyclone chamber C, an flow passage area of the air may increase, and thus, passage losses of air may be reduced to improve dust separation performance. Also, as the plurality of cyclone flows may be generated within the singular cyclone chamber C, the cyclone device 110 may decrease in size when compared to a structure in which one cyclone flow is generated.

Also, as the plurality of cyclone flows may be generated within the singular cyclone chamber C, dust separation performance similar to that of a structure in which air sequentially flows along a plurality of cyclone devices may be obtained. Thus, an additional cyclone device that re-separates the dust from the air exhausted from the cyclone device is not required. However, in this embodiment, additional cyclone devices may be further provided.

The separated dust (dotted lines in FIG. 9) may be discharged from the central portion of the cyclone device 110 to the dust discharge parts 114 and 115. Thereafter, the dust may flow within the dust discharge parts 114 and 115, and may then drop into the dust container 200.

On the other hand, the air (straight lines in FIG. 9) from which the dust may be separated may be filtered while passing through one or more holes 142 of the respective filter member 140. Then, the air may flow into the air exhaust passage 118 through the exhaust opening 116. The air within the respective air exhaust passages 118 may flow along the exhaust passage 332 of the exhaust member 330, and then may be exhausted from the dust separator 60 through the air exhaust hole 311.

Figure 10:
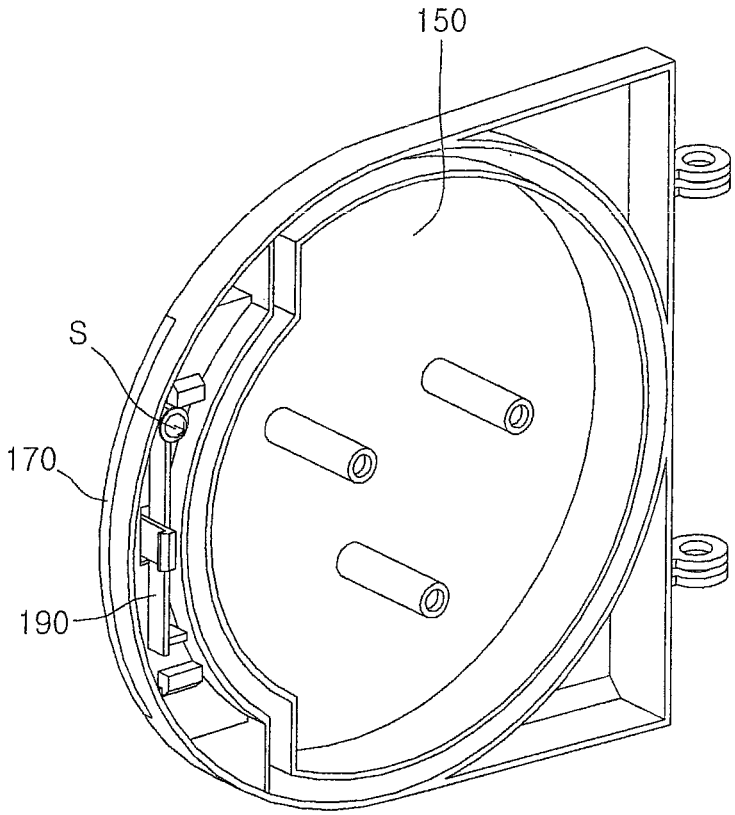
FIG. 10 is a perspective view showing a coupling member coupled to a cover member according to the embodiment of FIG. 1.
Figure 11:
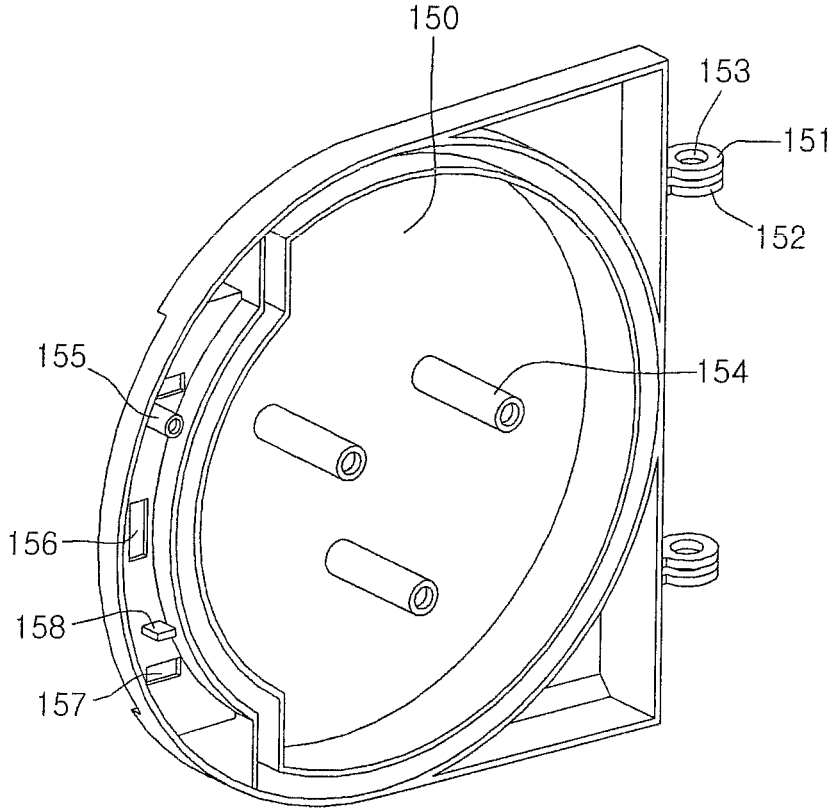
FIG. 11 is a perspective view of the cover member according to the embodiment of FIG. 1.
Figure 12:
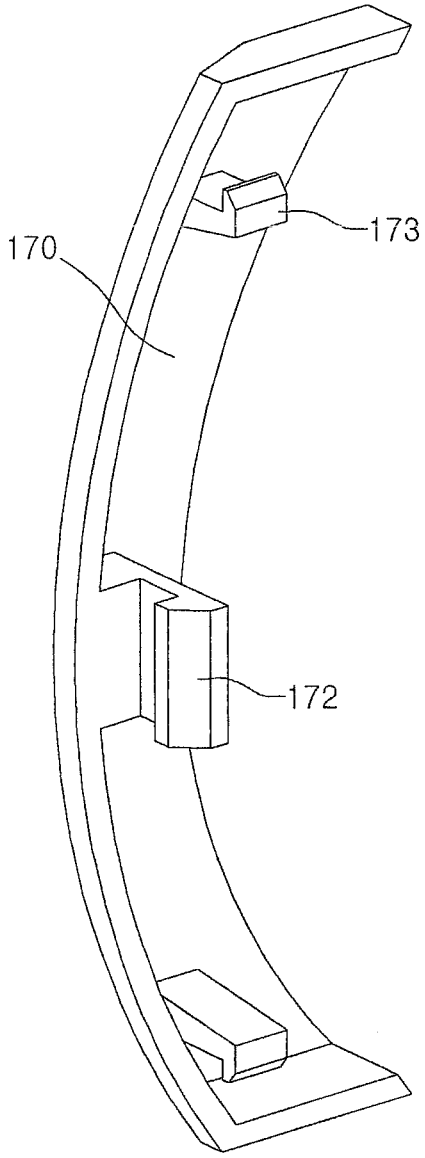
FIG. 12 is a perspective view of the coupling member according to the embodiment of FIG. 1.

FIG. 10 is a perspective view showing a coupling member coupled to a cover member according to the embodiment of FIG. 1. FIG. 11 is a perspective view of the cover member according to the embodiment of FIG. 1. FIG. 12 is a perspective view of the coupling member according to the embodiment of FIG. 1.

Referring to FIGS. 4, and 10 to 12, the cover member 150 may be rotated in a state in which it is coupled to the cover coupling part 160. The cover member 150 may cover a side of the exhaust guide 117.

A plurality of coupling bosses 154, which may be coupled to the filter member 140 by coupling members, may be disposed on the cover member 150. Also, a plurality of rotation guides 151 and 152 configured to rotate the cover member 150 may be disposed on the cover member 150. The plurality of rotation guides 151 and 152 may be vertically spaced from each other, as shown in FIG. 11. An insertion hole 153, in which a shaft 180 may be inserted, may be defined in each of the rotation guides 151 and 152. One portion of the shaft 180 may be coupled to the cover coupling part 160, and the other portion of the shaft 180 may pass through the insertion hole 153 of each of the plurality of rotation guides 151 and 152 and be coupled to the plurality of rotation guides 151 and 152.

The cover member 150 may include a coupling part 155, to which a fastening member, for example, a screw, may be attached, that prevents an elastic member 190 from being separated in a state in which the elastic member 190 is seated, and a support rib 158 that supports the elastic member 190.

The cover member 150 may have a through-hole 156 through which the coupling hook 172 of the coupling member 170 may pass, and a guide hole 157, to which a guide hook 173 of the coupling member 170 may be coupled.

The coupling hook 172 may be elastically supported by the elastic member 190 in a state in which the coupling hook 172 passes through the through-hole 156. For example, a leaf spring may be used as the elastic member to increase space utilization. The elastic member 190 may apply a force to the coupling hook 172 in a direction in which the coupling hook 172 is inserted into the coupling part 119. The through-hole 156 and the guide hole 157 may have horizontal lengths greater than those of the coupling hook 172 and the guide hook 173, such that the coupling hook 172 and the guide hook 173 may be moved in left and right direction with respect to the cover member 150 in a state in which the coupling hook 172 and the guide hook 173 pass through the through-hole 156 and the guide hole 157.

The coupling member 170 may include the coupling hook 172 and the plurality of guide hooks 173. The respective guide hooks 173 may be disposed spaced apart from at an upper side and a lower side of the coupling hook 172, respectively.

Figure 13:
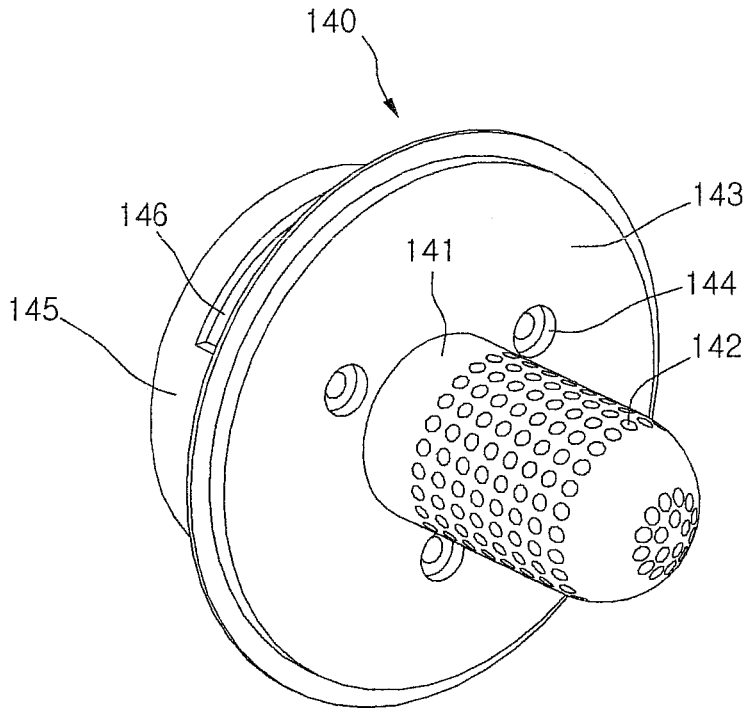
FIG. 13 is a perspective view of a filter member according to the embodiment of FIG. 1.

FIG. 13 is a perspective view of a filter member according to the embodiment of FIG. 1. Referring to FIGS. 4, and 10 to 13, the filter member 140 may include a filter body 141, an opening cover 143, and a flow guide 145. A plurality of holes 142, through which air may pass, may be defined in the filter body 141. The opening cover 143 may extend from an outer surface of the filter body 141 to selectively cover the exhaust opening 116. The flow guide 145 may guide a flow of the air passing through the holes 142.

The filter body 141 may pass through the exhaust opening 116 and may be selectively inserted into the cyclone chamber C. At least portion of the filter body 141 may have a cylindrical shape.

The filter body 141 may be selectively inserted into the cyclone chamber C for easy cleaning of the inside of the cyclone chamber C and the filter body 141. That is, when the cover member 150, to which the filter member 140 may be coupled, is rotated, the filter body 141 may be withdrawn to the outside of the cyclone chamber C. Thus, a user may easily clean the filter body 141 or the inside of the cyclone chamber C.

A plurality of coupling holes 144, through which a coupling member to be coupled to the cover member 150 may pass, may be defined in the opening cover 143. At least portion of the flow guide 145 may have a cylindrical shape, and a flow hole 146, through which the air passing through the filter body 141 may pass, may be defined in the flow guide 145.

Figure 14:
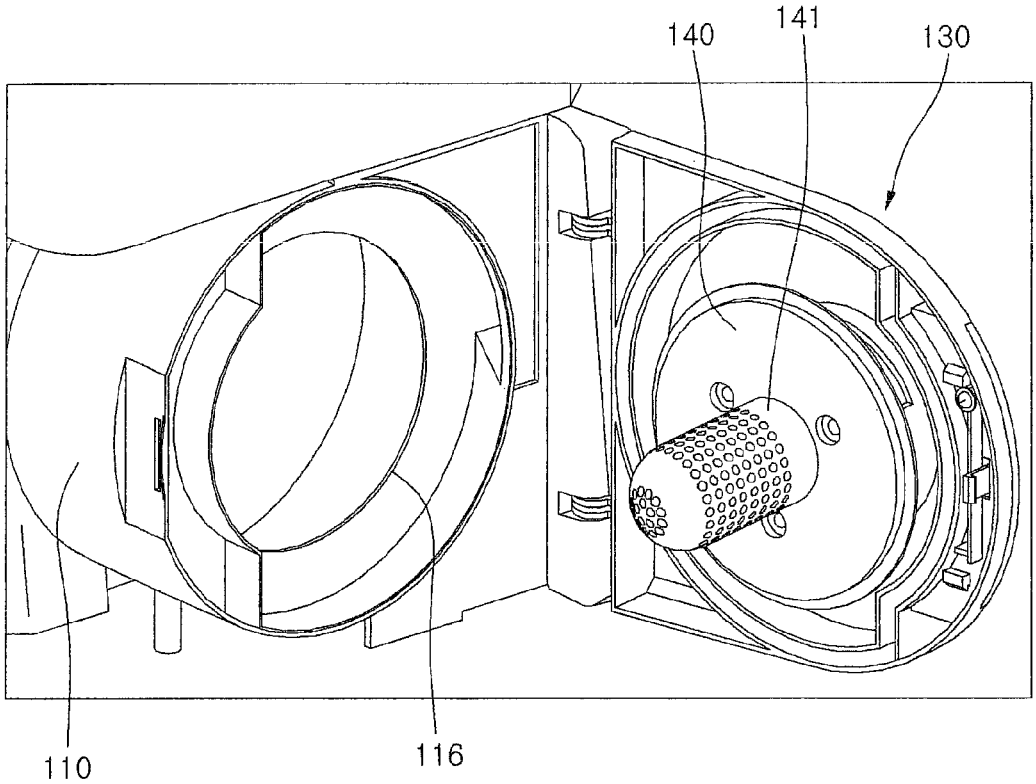
FIG. 14 is a perspective view showing a state in which a filter device is rotated according to the embodiment of FIG. 1.

FIG. 14 is a perspective view showing a state in which a filter device is rotated according to the embodiment of FIG. 1. Referring to FIGS. 9 to 14, when the dust separation process is performed in the cyclone device 110, hairs may be wound on the filter body 141 or dust may block the holes 142 of the filter bodies 141. In such a case, since the air does not smoothly pass through the filter body 141, the dust separation performance may be reduced. As a result, cleaning of the filter body 141 may be required.

In this embodiment, since the plurality of filter bodies 141 may be disposed within the cyclone device 110, even if dust blocks one of the filter bodies, the air may pass through the other filter bodies. Thus, according to this embodiment, the dust separation performance may be prevented from being significantly reduced when compared to when only one filter body is provided.

Also, when dust having a large volume is held in the inside or at inlets of the dust discharge parts 114 and 115, since the dust is not discharged, cleaning of the dust discharge parts 114 and 115 may be required. To clean the inside of the cyclone device 110 or the filter body 141, the user may first operate the coupling member 170. As a result, the coupling hook 172 of the coupling member 170 is separated from the coupling part 119 of the cyclone device 110. Also, the cover member 150 coupled to the filter member 140 may be rotated. When the cover member 150 is rotated, the filter body 141 disposed inside the cyclone device 110 may be withdrawn to the outside of the cyclone device 110. When the filter body 141 is withdrawn to the outside of the cyclone device 110, the user may clean the filter body 141 or the inside of the cyclone device 110.

According this embodiment, when the filter member 140 is rotated, the filter body 141 is withdrawn to the outside of the cyclone device 110, and simultaneously, the exhaust opening 116 is opened. Thus, the filter body 141 or the inside of the cyclone device 110 may be cleaned without dismantling the cyclone device 110.

Figure 15:
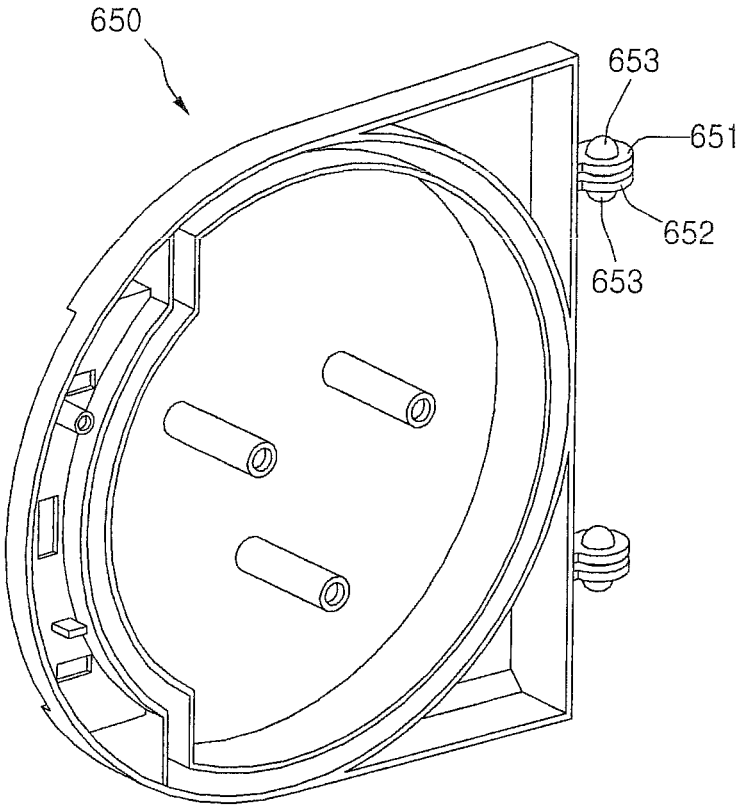
FIG. 15 is a perspective view of a cover member according to another embodiment.

FIG. 15 is a perspective view of a cover member according to another embodiment. This embodiment is similar to the previous embodiment except for a structure of a rotation guide that guides rotation of a cover member. Thus, repetitive description has been omitted.

Referring to FIG. 15, a cover member 650 according to this embodiment may include a plurality of rotation guides 651 and 652. The plurality of rotation guides 651 and 652 may include a first guide 651 and a second guide 652, which may be vertically spaced from each other. A portion of each of the guides 651 and 652 connected to the cover member 650 may have a thickness less than a thickness of the other portions thereof. Thus, the guides 651 and 652 may be elastically moved with respect to the cover member 650.

Hinge shafts 653 may protrude from the guides 651 and 652 in direction away from each other, respectively. That is, the hinge shaft 653 of the first guide 651 may protrude upwardly, and the hinge shaft 653 of the second guide 652 may protrude downwardly. A shaft insertion hole (not shown), in which the respective hinge shafts 653 may be inserted, may be defined in the cover coupling part (see reference numeral 160 of FIG. 4) to support the cover member 650. According to this embodiment, since the hinge shafts 653 are integrated with the cover member 650, a separate hinge shaft may not be required, simplifying a structure of the cover member 650.

Figure 16:
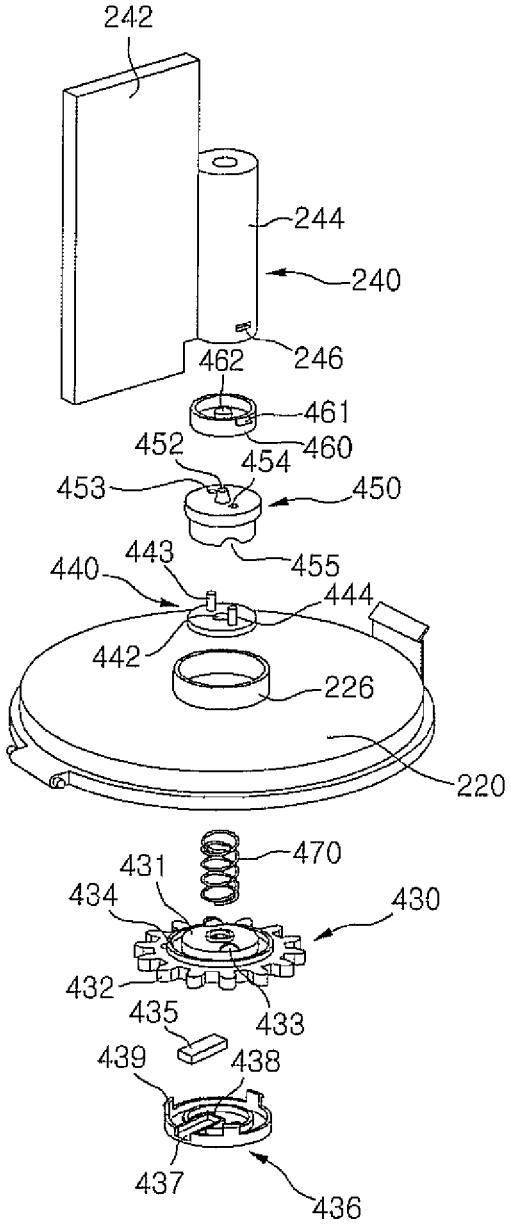
FIG. 16 is an exploded perspective view of a dust container having a compression member according to the embodiment of FIG. 1.
Figure 17:
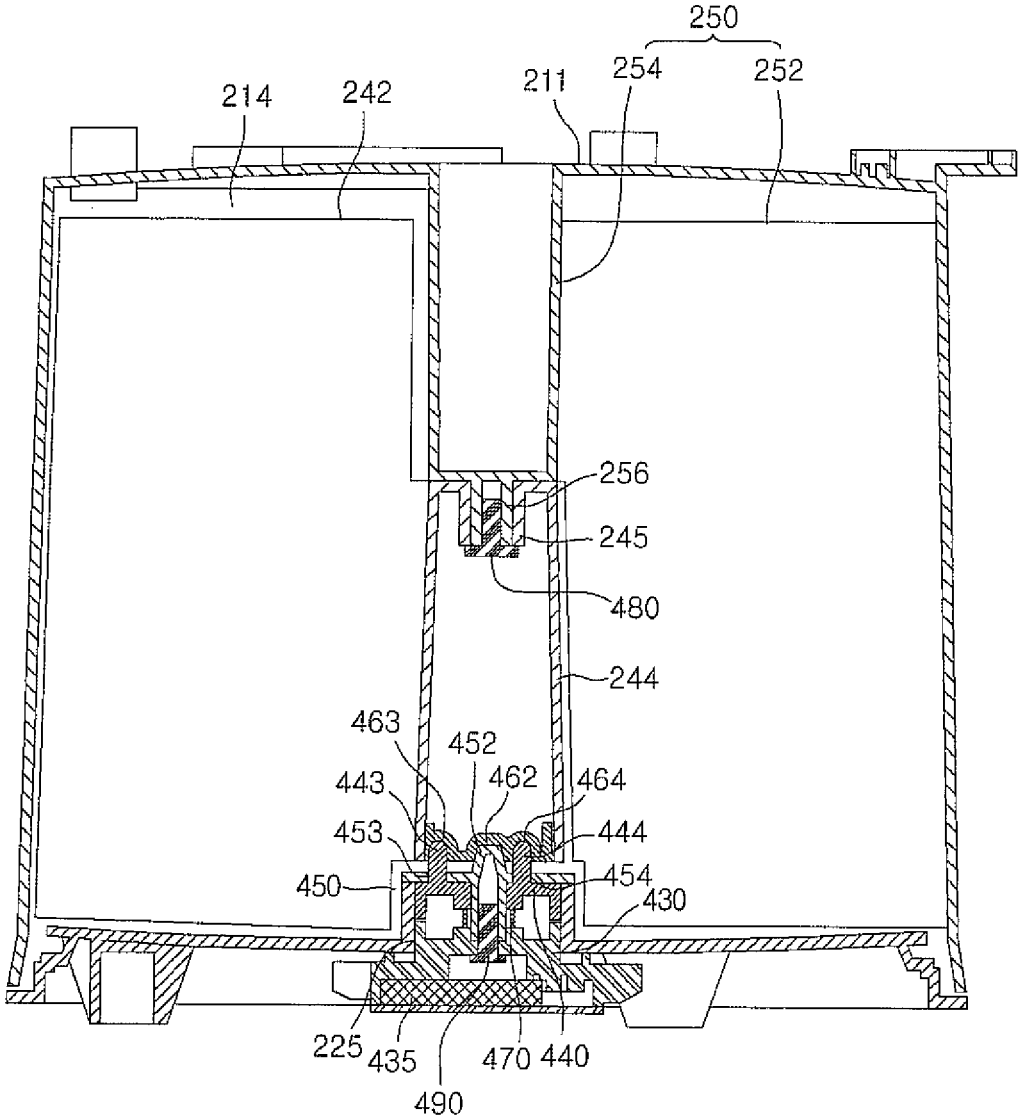
FIG. 17 is a vertical sectional view of the dust container according to the embodiment of FIG. 1.
Figure 18:
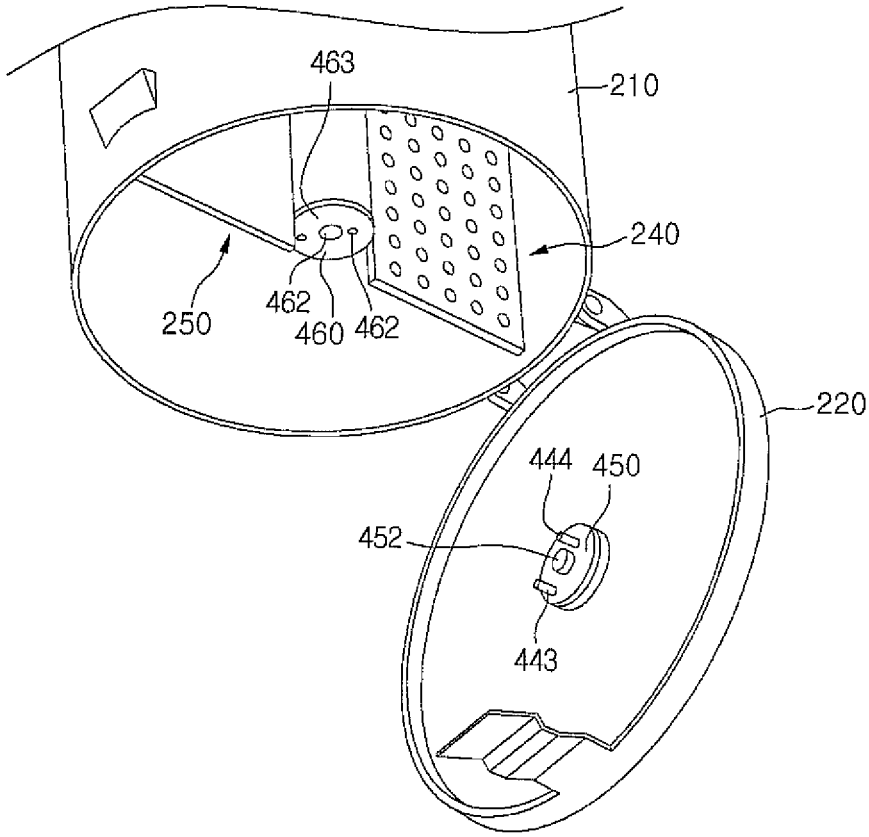
FIG. 18 is a perspective view showing a state in which a lower cover of the dust container is rotated according to the embodiment of FIG. 1.

FIG. 16 is a partially exploded perspective view of a dust container having a compression member according to the embodiment of FIG. 1. FIG. 17 is a vertical sectional view of the dust container according to the embodiment of FIG. 1. FIG. 18 is a perspective view showing a state in which a lower cover of the dust container is rotated according to the embodiment of FIG. 1.

Referring to FIGS. 2, 4 and 16 to 18, the first compression member 240 may include a rotation shaft 244 and a first compression plate 242, which may be integrated with the rotation shaft 244, configured to compress the dust. The second compression member 250 may include a fixed shaft 254 coupled to the rotation shaft 244 and a second compression plate 252, which may be integrated with the fixed shaft 254. The dust stored in the dust storage part 214 may be compressed by an interaction between the first compression plate 242 and the second compression plate 252.

That is, the first compression plate 242 may be moved toward one side of the second compression plate 252 to compress the dust disposed between one side of the second compression plate 252 and the first compression plate 242. Also, the first compression plate 242 may be moved toward the other side of the second compression plate 252 to compress the dust disposed between the other side of the second compression plate 252 and the first compression plate 242.

The fixed shaft 254 may be integrated with a top surface 211 of the dust collector body 210 and/or an inner circumference of the dust collector body 210. A coupling boss 256 may protrude downwardly from the fixed shaft 254. An insertion part 245, in which the coupling boss 256 may be inserted, may be disposed on the rotation shaft 244. A coupling member 480 may be coupled to the coupling boss 256 in a state in which the coupling boss 256 is inserted into the insertion part 245.

The first compression member 240 may be automatically moved by a driving device. The driving device may include a driving source that drives the first compression member 240 and a power transmission that transmits power of the driving source to the first compression member 240.

For example, a compression motor (see reference numeral 410 of FIG. 19) may be used as the driving source. The power transmission may include a main body transfer part 420 (see FIG. 2) coupled to the compression motor (see reference numeral 410 of FIG. 19) and disposed in the main body 10 and a transfer device selectively connected to the main body transfer part 420.

The transfer device may include a first transfer part 430, a second transfer part 440, a fixed part 450, a connection part 460, and an elastic member 470. The first transfer part 430 may be disposed below the lower cover 220. The second transfer part 440 may be disposed above the lower cover 220 and rotated together with the first transfer part 430. The fixed part 450 may be disposed on the second transfer part 440 and coupled to the first transfer part 430. The connection part 460 may be coupled to the rotation shaft 244 of the first compression member 240 and selectively connected to the fixed part 450. The elastic member 470 may be disposed on the first transfer part 430 to elastically support the second transfer part 440.

Figure 19:
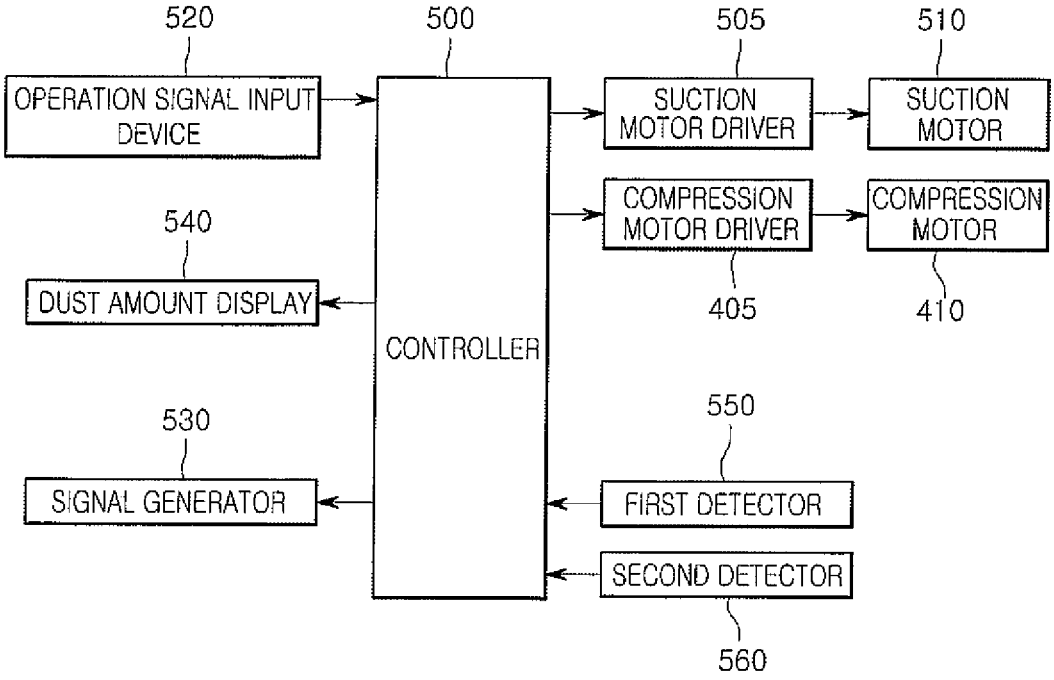
FIG. 19 is a block diagram of a control structure of a vacuum cleaner according to the embodiment of FIG. 1.

In more detail, the compression motor (see reference numeral 410 of FIG. 19) may be disposed inside the main body 10, and a portion of the main body transfer part 420 may be exposed from the mounting part 11 in a state in which the main body transfer part 420 is coupled to the compression motor (see reference numeral 410 of FIG. 19). When the dust container 200 is mounted on the mounting part 11, the main body transfer part 420 may be connected to the first transfer part 430. For example, a gear may be used as each of the main body transfer part 420 and the first transfer part 430.

The first transfer part 430 may include a gear body 431, a plurality of gear teeth 432, a magnetic member 435, and a gear cover 436. The plurality of gear teeth 432 may be disposed along a circumferential surface of the gear body 431. The magnetic member 435 may be received into a lower side of the gear body 431. The gear cover 436 may be coupled to a lower portion of the gear body 431 to cover the magnetic member 435.

The magnetic member 435 may have a rectangular bar shape. A seat part 437, on which the magnetic member 435 may be seated and having a shape corresponding to that of the magnetic member 435, may be disposed on the gear cover 436. The seat part 437 may extend from a central portion of the gear cover 436 in a radius or radial direction. A guide rib 438 that guides the seating of the magnetic member 435 may be disposed on a portion of a circumference of the seat part 437. A plurality of hooks 439, which may be coupled to the gear body 431, may be disposed on or along a circumference of the gear cover 436.

The plurality of hooks 439 may be arranged different distances apart from each other, and the gear cover 436 may be coupled to the gear body 431 at a predetermined position in a state in which the magnetic member 435 is seated on the gear cover 436. Hook coupling holes 434, to which the plurality of hooks 439 may be coupled, may be defined in the gear body 431. Also, a guide rib 433 that guides a coupling of the fixed part 450 may be disposed on a top surface of the gear body 431.

The gear cover 436 may be coupled to a lower portion of the gear body 431 in a state in which the magnetic member 435 is seated on the gear cover 436. Thus, when the gear body 431 is rotated, the magnetic member 435 may be rotated together with the gear body 431.

A portion of the gear body 431 may pass through an opening 225 defined in a central portion of the lower cover 220. Further, a rotation guide 226 that guides the rotation of the gear body 431 passing through the opening 225 may be disposed on a top surface of the lower cover 220.

A hole 442, in which a portion of the fixed part 450 may be inserted, may be defined in a central portion of the second transfer part 440. A first guide part 443 and a second guide part 444, which may be selectively inserted into the connection part 460, may protrude from a top surface of the second transfer part 440. A distance from the hole 442 to the first guide part 443 may be different from a distance from hole 442 to the second guide part 444. This specifies connection positions between the guide parts 443 and 444 and the connection part 460.

An insertion protrusion 452, which may be inserted into the connection part 460, may be disposed on a central portion of the fixed part 450. A first through-hole 453 and a second through-hole 454, through which the guide parts 443 and 444 may respectively pass, may be defined in the fixed part 450.

A distance between the insertion protrusion 452 and the first through-hole 453 may be equal to a distance between the hole 442 and the first guide part 443. A distance between the insertion protrusion 452 and the second through-hole 454 may be equal to a distance between the hole 442 and the second guide part 444.

A seat groove 455 on which the guide rib 433 of the gear body 431 may be seated, may be defined in a lower portion of the fixed part 450. The fixed part 450 may be coupled to the gear body 431 by a coupling member 490 in a state in which the respective guide parts 443 and 444 pass through the respective through-holes 453 and 454, respectively. When the fixed part 450 is coupled to the gear body 431, the second transfer part 440 may be supported by the elastic member 470 to allow the second transfer part 440 to be vertically moved.

The connection part 460 may be coupled to a lower portion of the rotation shaft 244. A hook 461 may be disposed on the connection part 460. A hook insertion hole 246, in which the hook 461 may be inserted, may be defined in the rotation shaft 244.

The connection part 460 may include a protrusion receiving part 462, in which the insertion protrusion 452 may be inserted, a first receiving part 463, and a second receiving part 464. The guide parts 443 and 444 may be inserted into the first receiving part 463 and the second receiving part 464, respectively.

A distance between the protrusion receiving part 462 and the first receiving part 463 may be equal to a distance between the hole 442 and the first guide part 443. A distance between the protrusion part 462 and the second receiving part 464 may be equal to a distance between the hole 442 and the second guide part 444. Thus, the first guide part 443 may be received into the first receiving part 463, and the second guide part 444 may be received into the second receiving part 464.

Referring to FIG. 2, as described above, the mounting part 11 may include the first detector 550 that detects the mounting of the dust container 200 and a second detector 560 that detects a position (or movement) of the first compression member 240. In more detail, the respective detectors 550 and 560 may detect a magnetic force of the magnetic member 435. Since the magnetic member 435 is an object to be detected by the respective detectors 550 and 560, the magnetic member 435 may be called a detected object. Hall sensors may be used as the detectors 550 and 560.

The first detector 550 may be vertically disposed below the magnetic member 435 in a state in which the dust container 200 is mounted on the mounting part 11. The second detector 560 may be spaced apart from the first detector 550.

To effectively detect a magnetic force of the magnetic member 435, the second detector 560 may be vertically disposed below a path of the magnetic member 435 when the magnetic member 435 is rotated. Also, when the first compression plate 242 and the second compression plate 252 are arranged in a straight line, the second detector 560 may be vertically disposed below the magnetic member 435. Thus, the magnetic force of the magnetic member 435 may always be detected by the first detector 550 in a state in which the dust container 200 is mounted on the mounting part 11.

On the other hand, during the rotation of the magnetic member, the magnetic force of the magnetic member 435 may be detected only when the magnetic member 435 is disposed above the second detector 560. Therefore, the rotational position of the first compression member 240 may be confirmed.

Hereinafter, a process by which the respective guide parts are received into the respective receiving parts will be described.

Referring to FIGS. 16 to 18, when the lower cover 220 is rotated downwardly, the fixed part 450, the first transfer part 430, the second transfer part 440 may be rotated together with the lower cover 220. In a state illustrated in FIG. 18, when the lower cover 220 is rotated upwardly, the insertion protrusion 452 may be inserted into the protrusion receiving part 462.

If the respective guide parts 443 and 444 are aligned with the respective receiving parts 463 and 464, the respective guide parts 443 and 444 may be received into the respective receiving parts 463 and 464. On the other hand, if the respective guide parts 443 and 444 are not aligned with the respective receiving parts 463 and 464, the respective guide parts 443 and 444 may be compressed by a bottom surface of the connection part 460, and thus, the elastic member 470 may shrink. Therefore, the second transfer part 440 may be moved downwardly.

In this state, when the first transfer part 430 is rotated by the driving source, the second transfer part 440 may be rotated also. Further, since the respective guide parts 443 and 444 are not received into the respective receiving parts 463 and 464, the first compression member 240 may be maintained in a stopped state.

During the rotation of the second transfer part 440, when the respective guide parts 443 and 444 are aligned with the respective receiving parts 463 and 464, the respective guide parts 443 and 444 may be received into the respective receiving parts 463 and 464. As a result, the first compression member 240 may be rotated together with the second transfer part 440.

FIG. 19 is a block diagram of a control structure of a vacuum cleaner according to the embodiment of FIG. 1. Referring to FIG. 19, the vacuum cleaner according to this embodiment may include a controller 500, an operation signal input device 520, a signal generator 530, a suction motor driver 505, a compression motor driver 405, the first detector 550, the second detector 560, and a dust amount display 540. The operation signal input device 520 may select a suction power degree (for example, strong, medium, and weak modes). The signal generator 530 may generate an empty request signal of dust stored in the dust container 200 and a dust container non-installation signal. The suction motor driver 505 may operate the suction motor 510 according to an operation mode input from the operation signal input device 520. The compression motor driver 405 may operate the compression motor 410. The first detector 550 may detect mounting of the dust container 200. The second detector 560 may detect a position of the first compression member 240. The dust amount display 540 may display an amount of dust stored in the dust container 200 to the outside.

In more detail, the compression motor 410 may be forwardly or reversely rotatable. That is, a motor that can be rotated in both directions may be used as the compression motor 410. Thus, the first compression member 240 may be forwardly rotated (for example, in a clockwise direction) and reversely rotated (in a counter-clockwise direction). As the first compression member 240 is forwardly or reversely rotated, compressed dust may build up on both sides of the second compression member 250.

A synchronous motor may be used as the compression motor so as to forwardly or reversely rotate the compression motor 410. The synchronous motor may be forwardly or reversely rotated by the motor itself. In a case in which the motor is rotated in one direction, when a force having a value greater than a preset value is applied to the motor, the motor may be rotated in the other direction. The force applied to the motor represents a resistance (for example, torque) generated when the first compression member 240 compresses the dust. When the resistance reaches a preset value, the rotational direction of the motor is changed.

Since synchronous motors are generally well-known in the motor technology field, detailed description has been omitted. However, that the compression motor may be forwardly or reversely rotated by a synchronous motor is within the technical scope of this embodiment.

Even through the first compression member 240 may reach a point at which the first compression member is not rotated any longer while the first compression member 240 is rotated to compress the dust, the first compression member 240 may continuously compress the dust for a predetermined period of time. The point at which the first compression member is no longer rotated represents a case in which the resistance reaches the preset value.

When the resistance reaches the preset value, current applied to the motor significantly increases. Thus, when current variation is detected by a current detector (not shown) and the detected current variation is transmitted to the controller 500, the controller 500 may intercept the current applied to the motor for a predetermined period of time.

Thus, the first compression member 240 may maintain a state in which the dust is compressed in a state in which the first compression member 240 is stopped. After the predetermined elapsed time in the state in which the first compression member 240 is stopped, power is applied to the compression motor 410 to rotate the first compression member 240. The cut of timing of the power applied to the compression motor 410 is a case in which the resistance reaches the preset value. Therefore, when the compression motor 410 is operated again, the rotational direction of the compression motor 410 will be opposite to that in which the compression motor is rotated before the power is cut off. Also, the first compression member 240 may be continuously forwardly or reversely rotated at the same angular speed so that the compression motor 410 easily compresses the dust.

In case in which the dust container 200 is not mounted on the mounting part 11, the magnetic force of the magnetic member 435 may not be detected by the first detector 550. Thus, in this state, when an operation signal is input from the operation signal input 520, the signal generator 530 may generate the dust container non-installation signal under the control of the controller 500.

The controller 500 may determine an amount of dust stored in the dust container 200, based on a position of the first compression member 240 detected by the second detector 560. When the controller determines that an amount of dust stored in the dust container is greater than a reference amount, the signal generator may generate a dust empty request signal. To confirm a position of the first compression member 240 may be understood as that which confirms a position of the magnetic member 435.

The signal generated from the signal generator 530 may include an aural or audible signal, a visual signal, or a vibration directly transferred to the user. For example, a speaker or a light emitting diode (LED) may be used as the signal generator 530.

Figure 20:
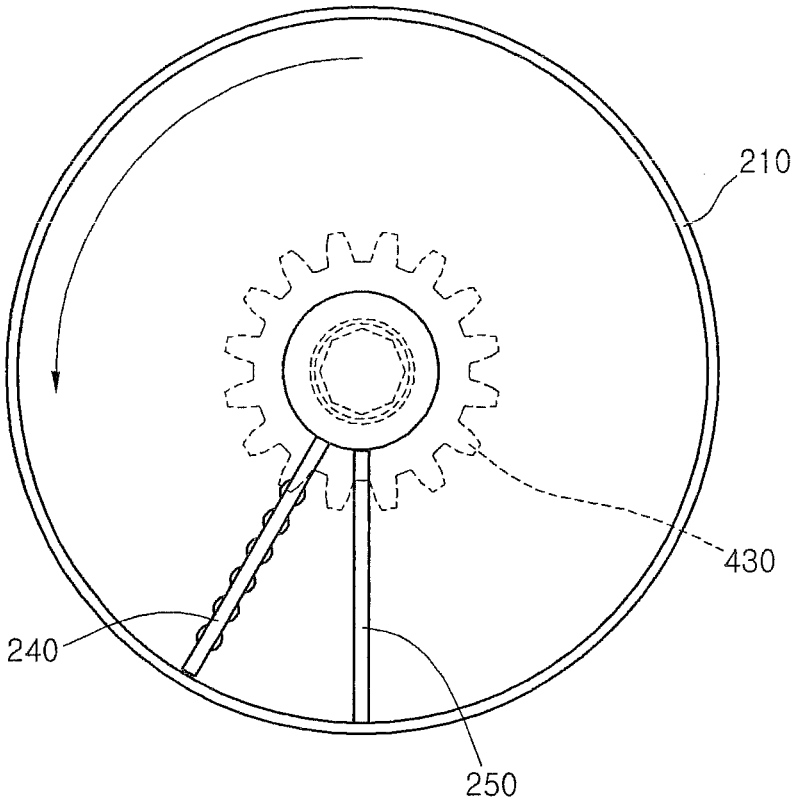
FIGS. 20 and 21 are views illustrating a position relationship between a magnetic member and a second detector in a case in which a first compression member is close to one side of a second compression member.
Figure 21:
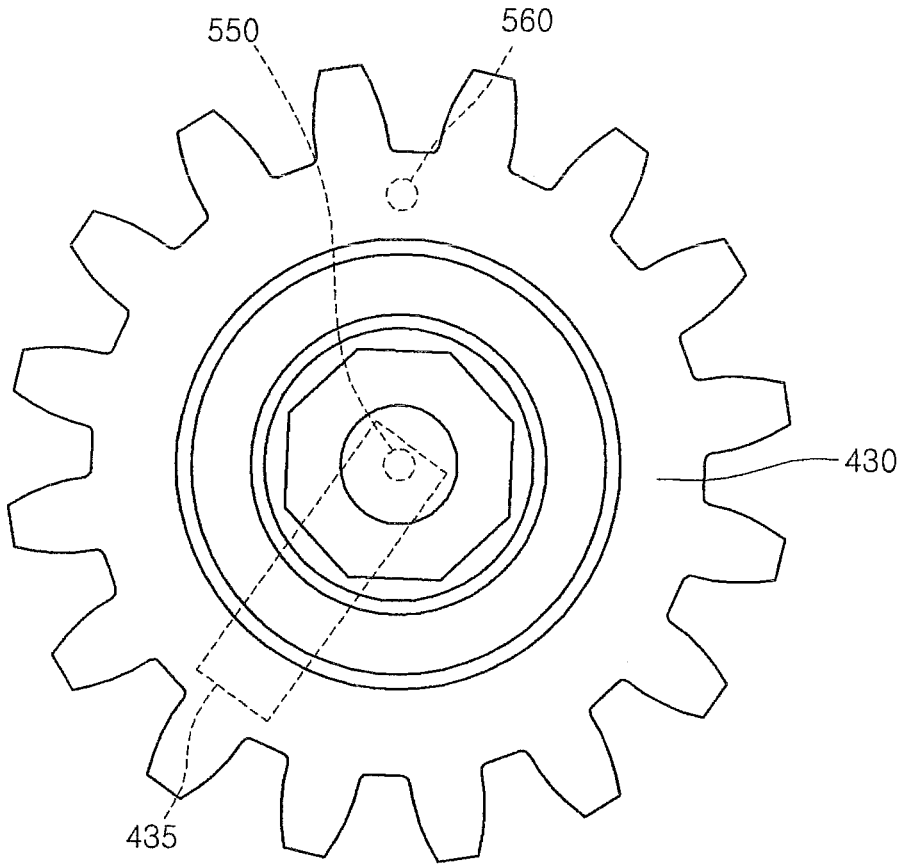
Figure 22:
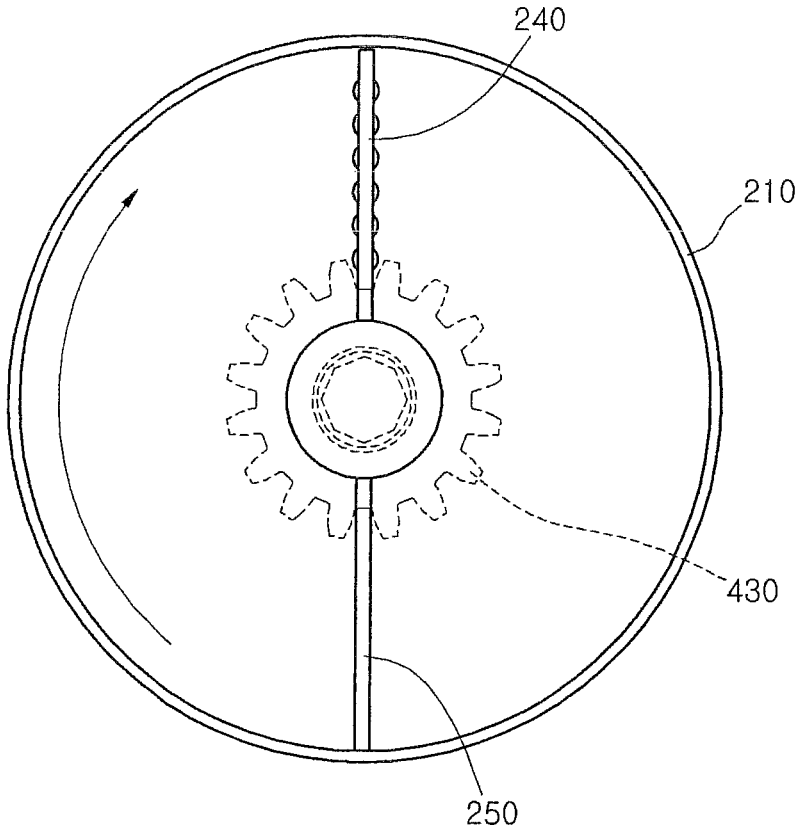
FIGS. 22 and 23 are views illustrating a positional relationship between the magnetic member and the second detector in a case in which the first compression member and the second compression are disposed in a straight line.
Figure 23:
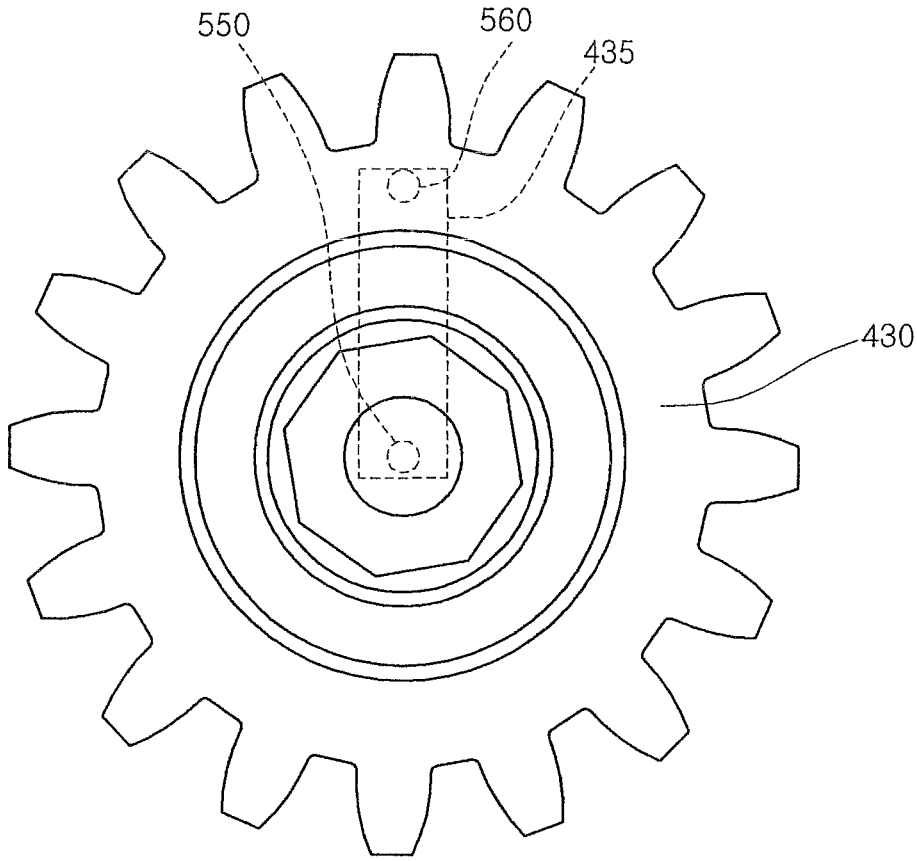
Figure 24:
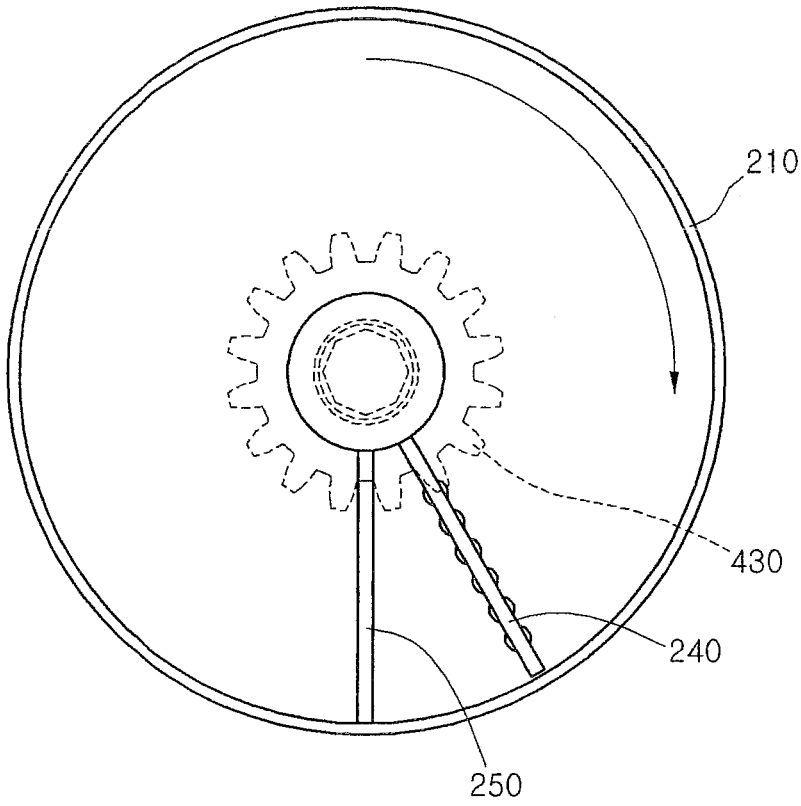
FIGS. 24 and 25 are views illustrating a positional relationship between the magnetic member and the second detector in a case in which the first compression member is close to the other side of the second compression member.
Figure 25:
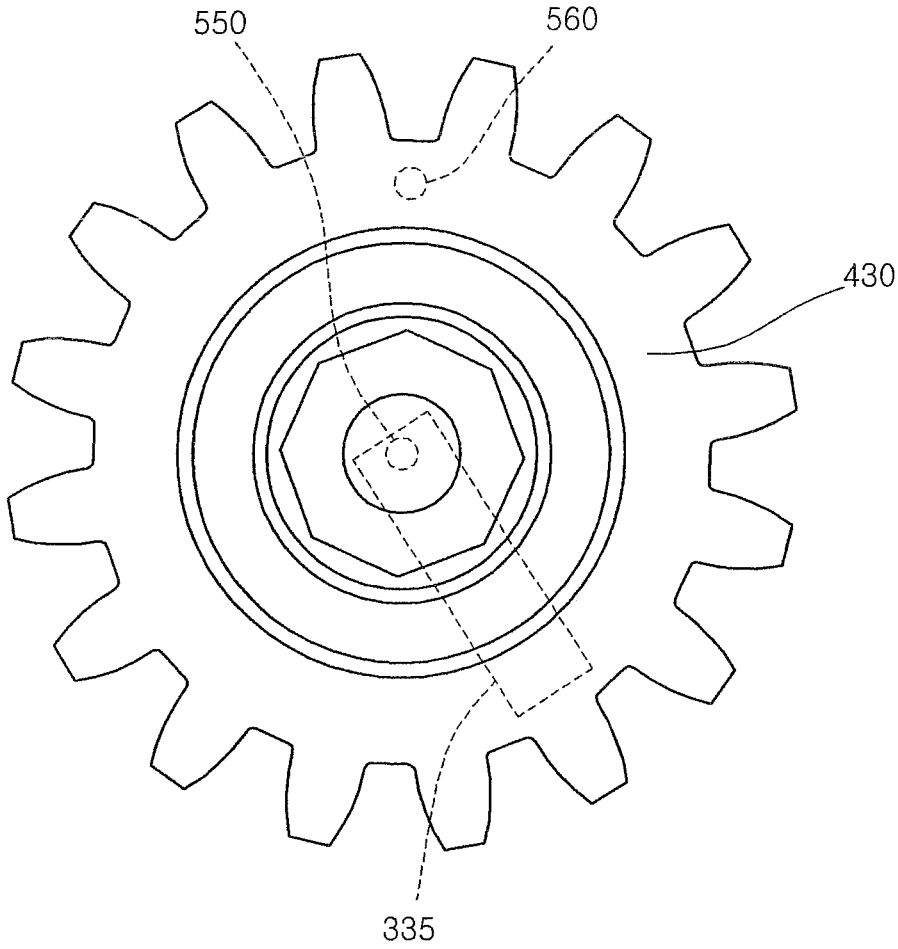

FIGS. 20 and 21 are views illustrating a positional relationship between a magnetic member and a second detector in a case in which a first compression member that compresses dust is close to one side of a second compression member. FIGS. 22 and 23 are views illustrating a positional relationship between the magnetic member and the second detector in a case in which the first compression member and the second compression are disposed in a straight line. FIGS. 24 and 25 are views illustrating a positional relationship between the magnetic member and the second detector in a case in which the first compression member is close to the other side of the second compression member.

Referring to FIGS. 20 to 25, when the first compression member 240 is rotated, and thus, the first compression member 240 and the second compression member 250 are disposed in a straight line, the magnetic member 435 may be vertically disposed above the second detector 560. Thus, the second detector 560 may detect the magnetic force of the magnetic member 435. A position of the first compression member 240 illustrated in FIG. 22, that is, a position, at which the second detector 560 may detect the magnetic force of the magnetic member 435, of the first compression member 240 may be referred to as a "reference position" for convenience of description.

When the first compression member 240 is rotated in a counter-clockwise direction with respect to the reference position, as illustrated in FIG. 20, since the magnetic member 435 is spaced from the second detector 560, the second detector 560 may not detect the magnetic force of the magnetic member 435.

Also, when the first compression member 240 rotated in the counter-clockwise direction is no longer rotated, the first compression member 240 is then rotated in a clockwise direction. Thus, the first compression member 240 passes through the reference position illustrated in FIG. 22, and then is rotated toward a right side of the second compression member 250, as illustrated in FIG. 24, to compress the dust stored in the dust container 200. When the first compression member 240 rotated in the clockwise direction is no longer rotated, the compression motor 410 may be rotated again in the counter-clockwise direction to repeatedly perform the above-described processes, thereby compressing the dust stored in the dust container 200.

Regarding the detection of the magnetic member 435 by the respective detectors 550 and 560, the reason the receiving positions of the guide parts 443 and 444 are specifically defined will be described below. That is, the reason the receiving positions of the guide parts 443 and 444 are specifically defined is to constantly maintain an angle (including 0 degree) between the magnetic member 435 and the first compression plate 242. In more detail, as described above, the reference position of the first compression member 240 may be a position in which the magnetic member 435 is vertically disposed above the second detector 560. The reference position should be equally maintained at any moment. For equally maintaining the reference position, the magnetic member 435 and the first compression member 240 may have the same angle.

In this embodiment, the first compression member 240 may be freely rotatably coupled to the dust container 200, and the first transfer part 430 including the magnetic member 435 may be freely rotatably coupled to the lower cover 220. Thus, in a case in which structures (that is, the respective guide parts 443 and 444 and the respective receiving parts 463 and 464) in which the relative position between the magnetic member 435 and the first compression member 240 is maintained are not provided, the relative position between the magnetic member 435 and the first compression member 240 may be varied whenever the lower cover 220 is opened or closed.

Thus, in this embodiment, the respective guide parts 443 and 444 and the respective receiving parts 463 and 464 are provided. Further, the respective guide parts 443 and 444 may be received into only the respective receiving parts 463 and 464. Therefore, in a state in which at least the first compression member 240 is rotated, the angle between the magnetic member 435 and the first compression member 240 may be constantly maintained (in this embodiment, 0 degree). Also, as the angle between the first compression member 240 and the magnetic member 435 are constantly maintained, an amount of dust may be precisely determined.

Figure 26:
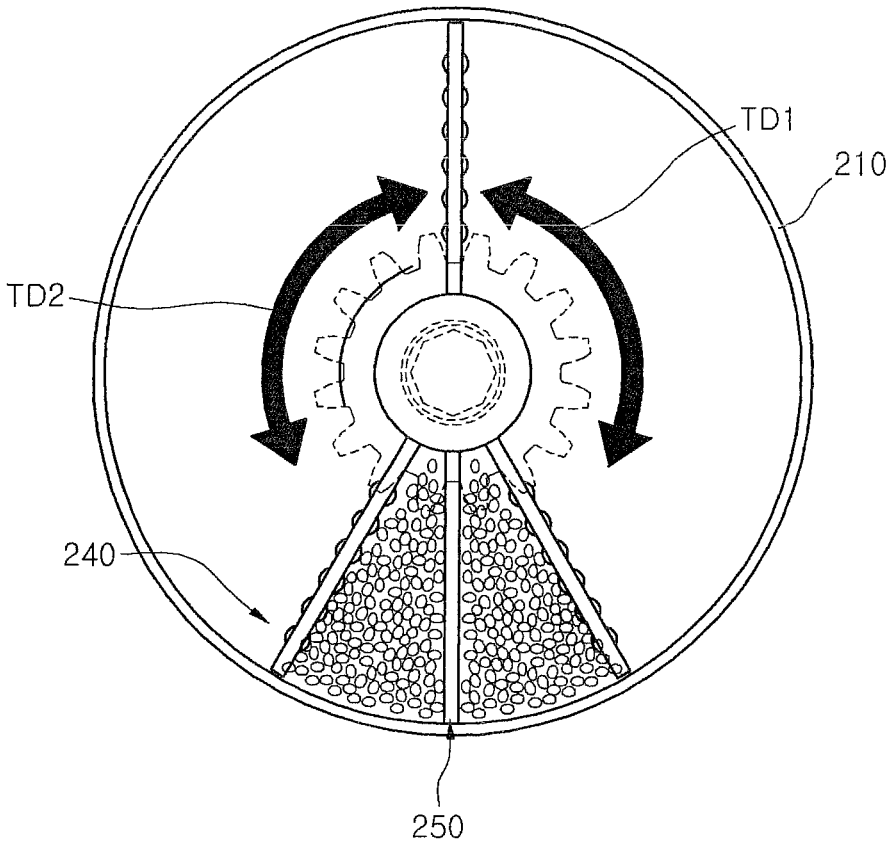
FIG. 26 is a view illustrating a rotational operation of the first compression member of FIGS. 20 to 25.

FIG. 26 is a view illustrating a rotational operation of the first compression member of FIGS. 20 to 25. A time TD1 required for the first compression member 240 to be rotated from the reference position in the counter-clockwise direction and then return again to the reference position, and a time TD2 required for the first compression member 240 to be rotated from the reference position in the clockwise direction and then return again to the reference position are illustrated in FIG. 26. For convenience of description, the time TD1 may be referred to as a first round-trip time TD1, and the time TD2 may be referred to as a second round-trip time TD2. Generally, since dust is uniformly distributed within the dust container 200, the first round-trip time TD1 may be substantially equal to the second round-trip time TD2.

When an amount of the dust compressed by the first compression member 240 gradually increases, the first round-trip time TD1 and the second round-trip time TD2 may gradually decrease. In this embodiment, when any one of the first round-trip time TD1 and the second round-trip time TD2 reaches a predetermined reference time, the controller may determine that the dust within the dust container 200 sufficiently builds up to allow the signal generator to generate the dust empty request signal.

Figure 27:
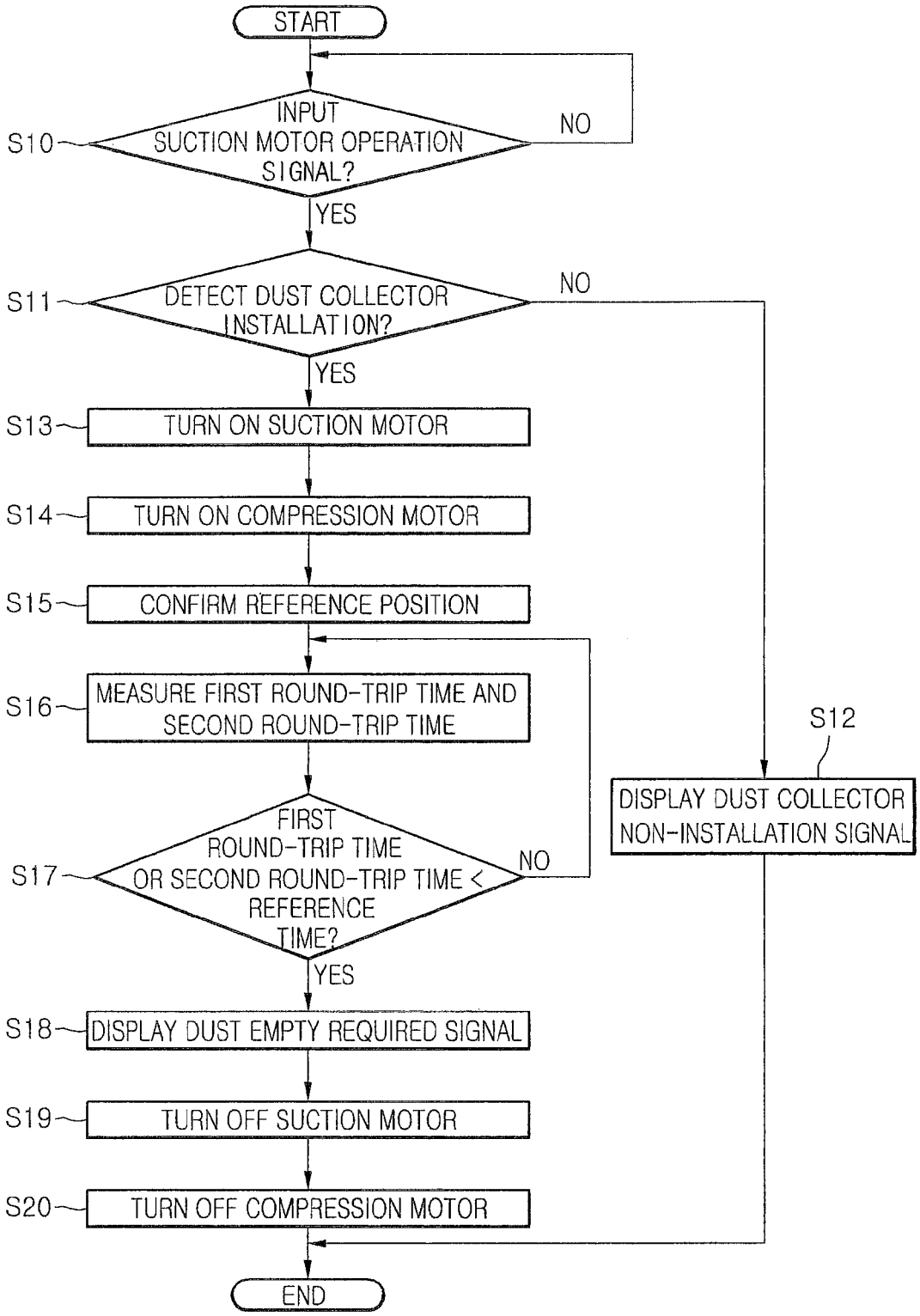
FIG. 27 is a flowchart of a control method of a vacuum cleaner according to the embodiment of FIG. 1.

FIG. 27 is a flowchart of a control method of a vacuum cleaner according to the embodiment of FIG. 1. Referring to FIG. 27, in a state in which an operation of the vacuum cleaner is stopped, the controller may determine whether a suction motor operation signal is input through the operation signal input device 520, in step S10.

When the controller 500 determines that the suction motor operation signal is input, the controller 500 may determine whether the dust container 200 is mounted or installed on the mounting part 11, in step S11. When the dust container 200 is not mounted on the mounting part 11, the magnetic force of the magnetic member 435 may not be detected by the first detector 550. In this case, the controller 500 may control the signal generator 530 to generate the dust container non-installation signal, in step S12. Then, the suction motor 510 may be maintained in a stopped state.

When the suction motor operation signal is input in a state in which the dust container 200 is not mounted, a user may easily confirm the non-installation of the dust container 200 by informing it to the outside, that is, informing a user. Also, the operation of the suction motor 510 may be stopped in the state in which the dust container 200 is not mounted to prevent the suction motor 510 from being unnecessarily operated.

On the other hand, when the magnetic force of the magnetic member 435 is detected by the first detector 550, and thus, the controller 500 determines that the dust container 200 is mounted, the controller 500 may operate the suction motor 510 according to a suction power selected by the user, in step S13.

When the suction motor 510 is operated, the dust may be sucked in through the suction nozzle 20 by the suction force generated by the suction motor 510. The air sucked in through the suction nozzle 20 may be introduced into the main body 10. The air introduced into the main body 10 of the vacuum cleaner may be separated from the dust in the dust separation device 100. The dust separated from the air may be stored in the dust container 200.

In the process in which the dust is separated from the air and the separated dust is stored in the dust container 200, the dust stored in the dust container 200 may be compressed by interaction between the plurality of compression members 240 and 250. That is, in step S14, the controller 500 may operate the compression motor 410 to compress the dust stored in the dust container 200 after the suction motor 510 is operated.

Although the compression motor 410 is operated after the suction motor 510 is operated in this embodiment, the suction motor 510 and the compression motor 410 may be operated at the same time. In step S14, when the compression motor 410 is operated, the main body transfer part 420 coupled to the compression motor 410 may be rotated. When the main body transfer part 420 is rotated, the first transfer part 430 engaged with the main body transfer part 420 may be rotated. When the first transfer part 430 is rotated, the second transfer part 440 may be rotated together with the first transfer part 430.

When the second transfer part 440 is rotated, the connection part 460 connected to the second transfer part 440 may be rotated. Thus, the first compression member 240 may be rotated toward the second compression member 250 to compress the dust.

In step S15, the controller 500 may confirm whether the first compression member 240 is disposed at the reference position. According to this embodiment, since the first round-trip time TD1 and the second round-trip time TD2 are measured based on the reference position of the first compression member 240, it may be necessary to confirm that the first compression member 240 is disposed at the reference position when the first compression member 240 is initially operated.

A time point at which the first compression member 240 is initially disposed at the reference position may be a time point at which the magnetic force of the magnetic member 435 may be initially detected by the second detector 560 during the operation of the compression motor 410. Thus, in step S16, the controller 500 may measure the first round-trip time TD1 and the second round-trip time TD2 of the first compression member 240 based on the time point at which the magnetic force of the magnetic member 435 is initially detected by the second detector 560. For example, the controller 500 may include a counter (not shown) that measures the respective round-trip times. As an amount of the dust compressed within the dust container 200 by the first compression member 240 and the second compression member 250 increases, a left-right round-trip rotation time of the first compression member 240 may gradually decrease.

Thus, in step S17, the controller 500 may determine the first round-trip time TD1 and the second round-trip time TD2 of the first compression member 240, and may also determine whether the first round-trip time TD1 or the second round-trip time TD2 reaches the reference time. The reference time may be a time set in the controller 500 by a designer or user. Thus, the reference time may be a base for determining that the dust builds up within the dust container 200. Since the reference time is obtained by repeatedly performing an experiment by the designer, a capacity of the dust container may be varied.

In this embodiment, when any one of the first round-trip time TD1 and the second round-trip time TD2 reaches the reference time (or less than the reference time), it may be determined that an amount of the dust reaches a predetermined amount (dust empty required amount). Or, when all of the first round-trip time TD1 and the second round-trip time TD2 reach the reference time, it may be determined that an amount of the dust reaches a predetermined amount (dust empty required amount).

According to the determined results in step S17, when any one of the first round-trip time TD1 and the second round-trip time TD2 is greater than the reference time, the process may return to step S16 to perform again step S16. On the other hand, when the first round-trip time TD1 or the second round-trip time TD2 reaches the reference time, the controller 500 may control the signal generator 530 to generate the dust empty required signal in step S18.

In step S19, the controller 500 may turn off the suction motor 510 to prevent the dust from being sucked. If the dust is forcedly sucked in a state in which an amount of the dust builds up within the dust container 200 exceeds a predetermined amount, suction efficiency may be reduced, and the suction motor 510 may be overloaded. Thus, in this embodiment, the suction motor 510 may be stopped. In step S20, the controller 500 may turn off the compression motor 410. The suction motor 510 and the compression motor 410 may be turned off one after the other or at the same time.

According to this embodiment, since the dust stored in the dust container 200 may be compressed by the interaction between the first compression member 240 and the second compression member 250, an amount of the dust stored in the dust container 200 may be maximized. Also, the dust container non-installation signal may be utilized to prevent the suction motor 510 and the compression motor 410 from being unnecessarily operated. Also, when an amount of the dust stored in the dust container 200 reaches a predetermined amount, the dust empty required signal may be utilized to allow the user to easily confirm a dust empty required time, thereby improving user convenience.

In addition to the above-described descriptions, this embodiment may further include the following. When a state in which the suction motor is stopped and the dust container is not mounted on the main body of the vacuum cleaner, the suction motor may be maintained in the stopped state, even through the suction motor operation signal is input. Alternatively, when the suction motor operation signal is input, the suction motor may be stopped after it is operated for a predetermined period of time. In this case, the user may more easily confirm the dust container non-installation through the operation stop of the suction motor.

Also, in case in which an amount of the dust exceeds the predetermined amount, when an operation of the suction motor is stopped, an operation of the compression motor may not be stopped. That is, when the operation of the suction motor is stopped, the operation of the compression motor may be stopped after the first compression member is moved to a side of the second compression member, so that the dust disposed between the first compression member and the side of the second compression member may be compressed.

Although a plurality of guide parts and receiving parts may be provided in this embodiment, one guide part and one receiving part may be sufficient, and thus, provided. Also, although the respective guide parts may be disposed on the second transfer part and the respective receiving parts may be disposed in the connection part in this embodiment, the respective receiving parts may be disposed in the second transfer part and the respective guide parts disposed on the connection part. Further, although the connection part may be coupled to the rotation shaft in this embodiment, the connection part may be integrated with the rotation shaft. However, in this case, the coupling boss 256 may protrude from the rotation shaft, the insertion part 245, in which the coupling boss 256 may be inserted, may be disposed in the fixed shaft 254, and the coupling member 480 may be inserted, into the coupling boss 256 from an upper side of the fixed shaft 254.

Figure 28:
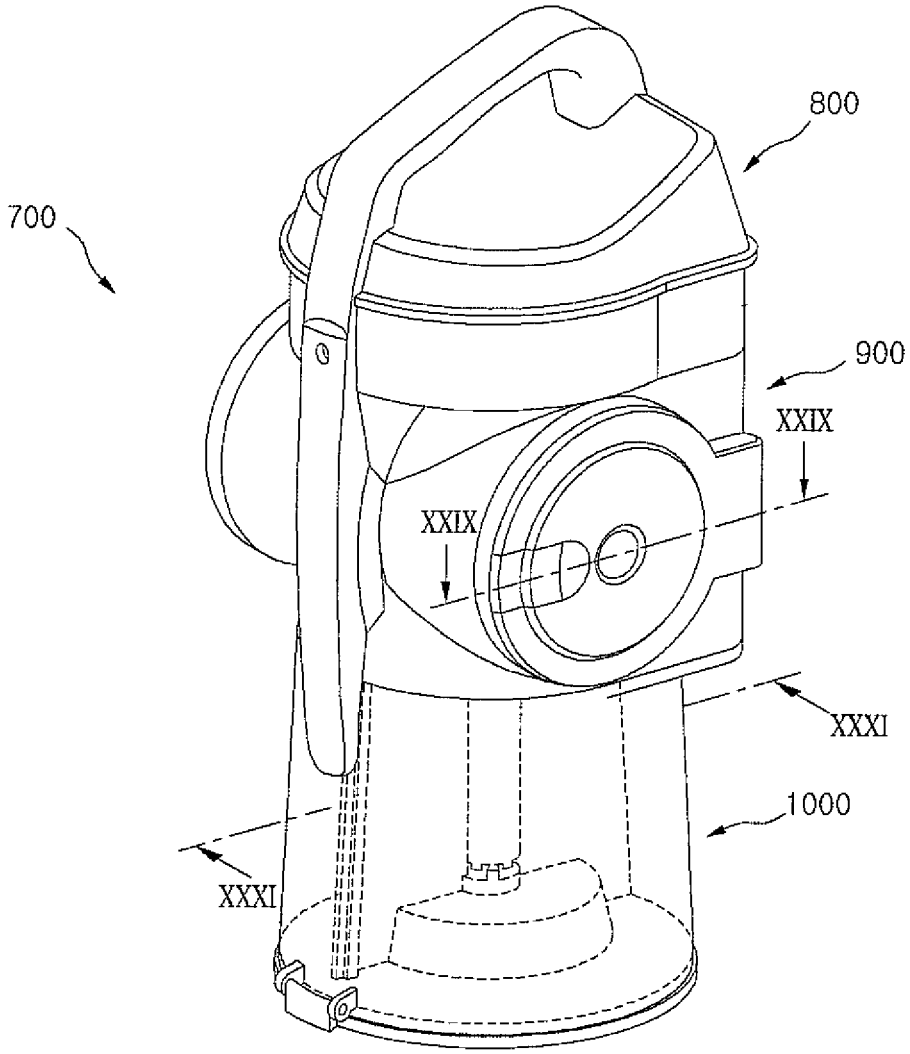
FIG. 28 is a perspective view of a dust separator according to another embodiment.
Figure 29:
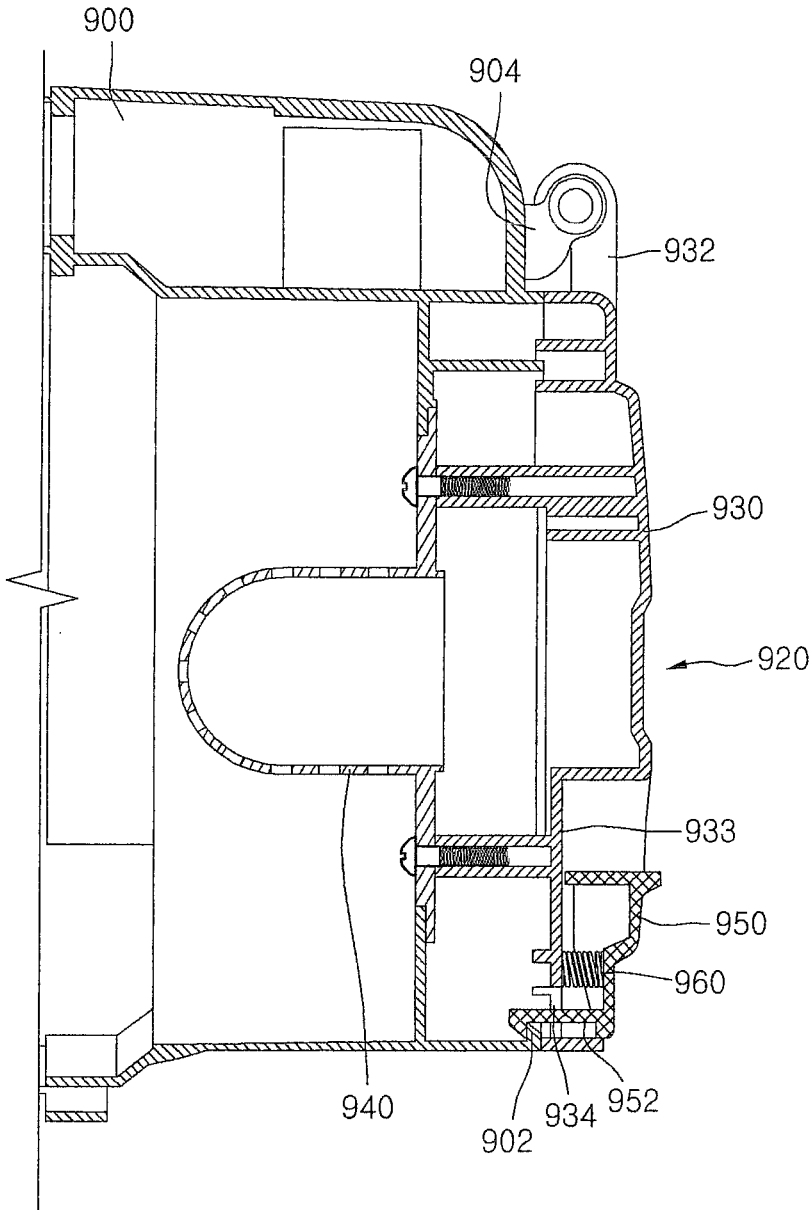
FIG. 29 is a sectional view taken along line XXIX-XXIX of FIG. 28.
Figure 30:
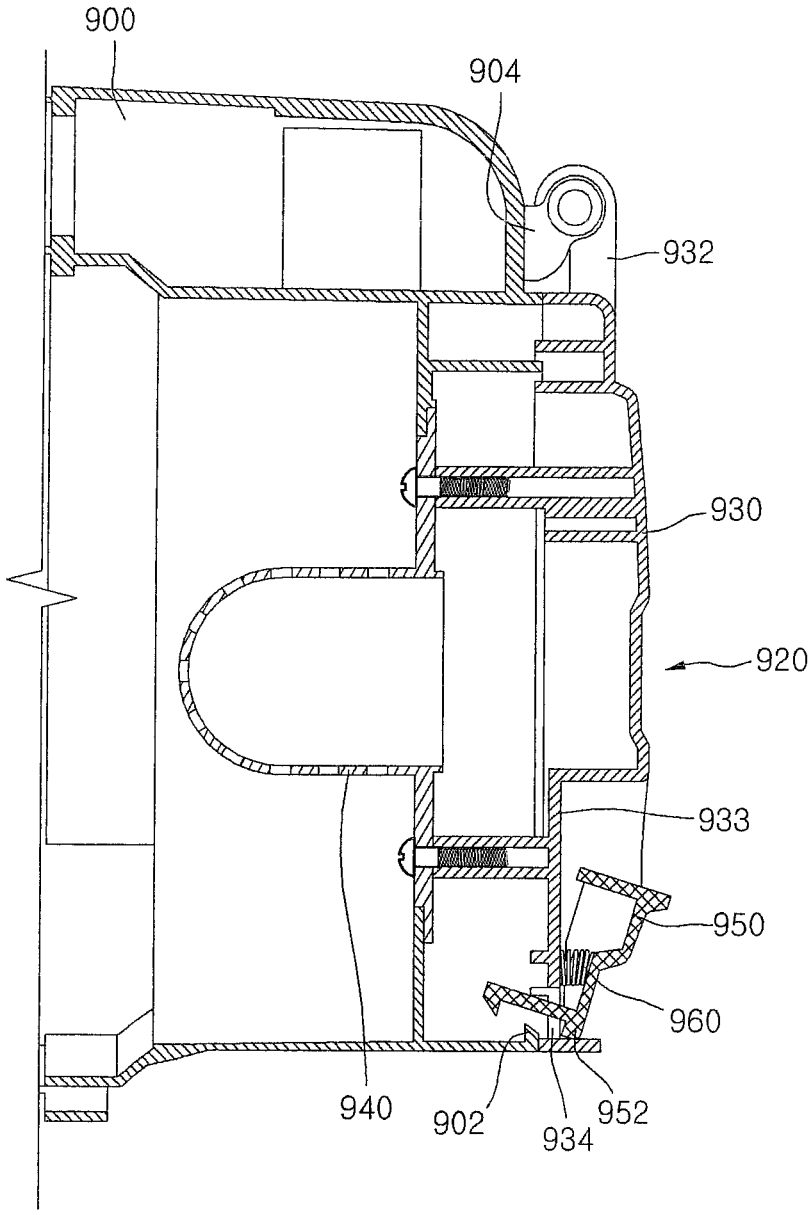
FIG. 30 is a sectional view taken along line XXIX-XXIX of FIG. 28 in a state in which a coupling between a coupling member and a dust separation device is released.

FIG. 28 is a perspective view of a dust separator according to another embodiment. FIG. 29 is a sectional view taken along line XXIX-XXIX of FIG. 28. FIG. 30 is a sectional view taken along line XXIX-XXIX of FIG. 28 in a state in which a coupling between a coupling member and a dust separation device is released.

Referring to FIGS. 28 to 30, a dust separator 700 according to this embodiment may include a dust separation device 900, a dust container 1000, and an exhaust guide device 800. The dust separation device 900 may separate dust from sucked air. The dust container 1000 may store the dust separated by the dust separation device 900. The exhaust guide device 800 may guide exhaust of the air separated by the dust separation device 900.

In this embodiment, since a structure of the exhaust guide device 800 is the same as that described with respect to the embodiment of FIG. 1, repetitive description has been omitted. Further, since a structure of the dust separation device of this embodiment is the same as that of the embodiment of FIG. 1 except for a coupling structure of a filter device, repetitive description of the dust separation device except for the filter device has been omitted.

The dust separation device 900 may include a plurality of filter devices 920. The plurality of filter devices 920 may be rotatably coupled to the dust separation device 900 to filter air in which a dust separation process is performed within the dust separation device 900.

In more detail, each of the filter devices 920 may include a filter member 940 selectively inserted into the dust separation device 900 and a cover member 930 coupled to the filter member 940. The filter member 940 may include the flow guide (see reference numeral 145 of FIG. 13) described with respect to the embodiment of FIG. 1.

A hinge part 932 may be disposed on the cover member 930. A hinge coupling part 904, to which the hinge part 932 may be coupled, may be integrated to the outside of the dust separation device 900.

The cover member 930 may include a coupling member 950 selectively coupled to the dust separation device 900. In more detail, the coupling member 950 may be rotatably coupled to the outside of the cover member 930. A receiving part 933 configured to receive the coupling member 950 may be recessively disposed in the cover member 930. An elastic member 960 that elastically supports the coupling member 950 may be disposed in the receiving part 933.

An opening 934, through which a hook 952 of the coupling member 950 may pass, may be defined in the cover member 930. A hook hanger 902 that selectively hooks the hook 952 may be disposed in the dust separation device 900.

Referring to FIG. 29, to withdraw the filter member 940 to the outside of the dust separation device 900, a user may operate the coupling member 950, as illustrated in FIG. 30. As a result, the elastic member 960 may be compressed to release the hooking effect between the hook 952 of the coupling member 950 and the hook hanger 902. Thus, the cover member 930 coupled to the filter member 940 may be rotatable with respect to the dust separation device 900. Then, when the cover member 930 is rotated, the filter member 940 disposed within the dust separation device 900 may be withdrawn to the outside. In a state in which the filter member 940 is withdrawn to the outside of the dust separation device 900, the user may clean the filter member 940 or the inside of the dust separation device 900.

Figure 31:
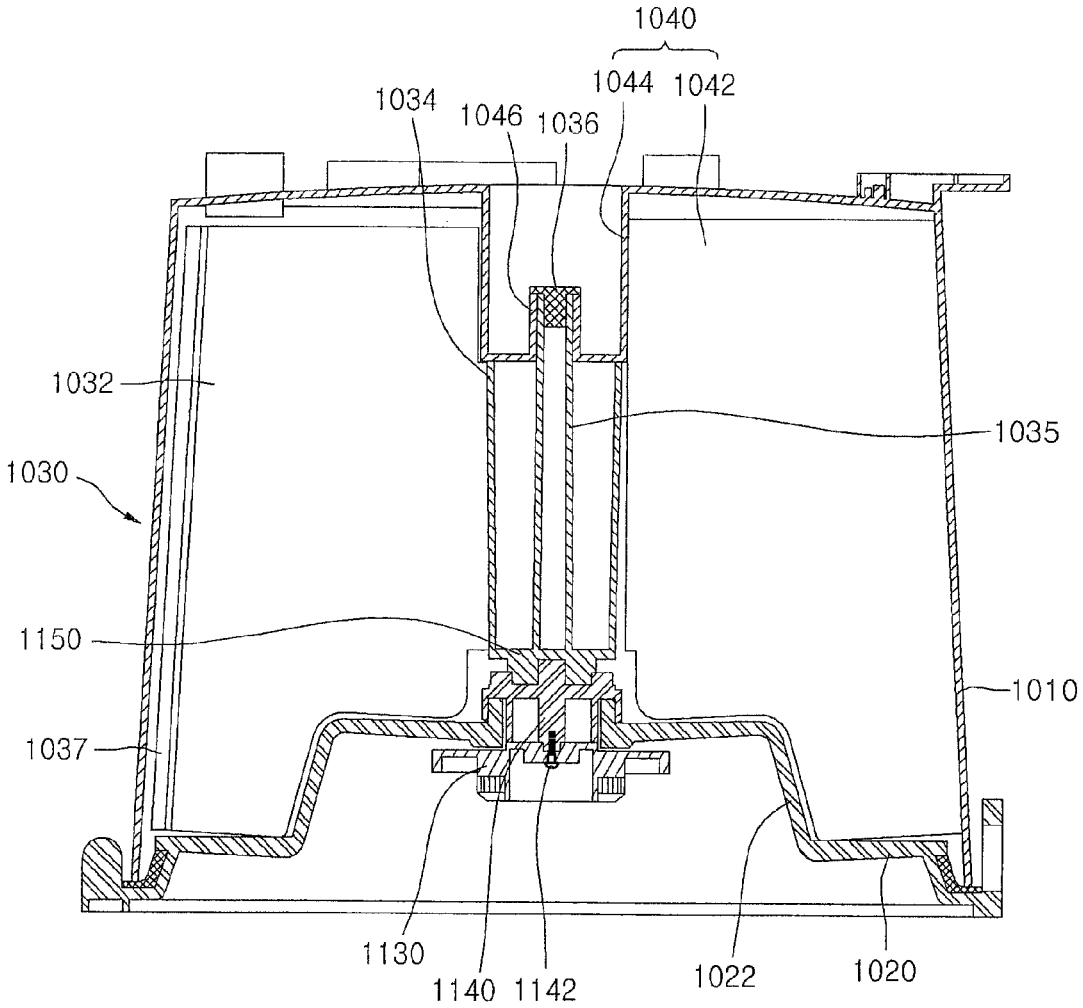
FIG. 31 is a sectional view taken along line XXXI-XXXI of FIG. 28.
Figure 32:
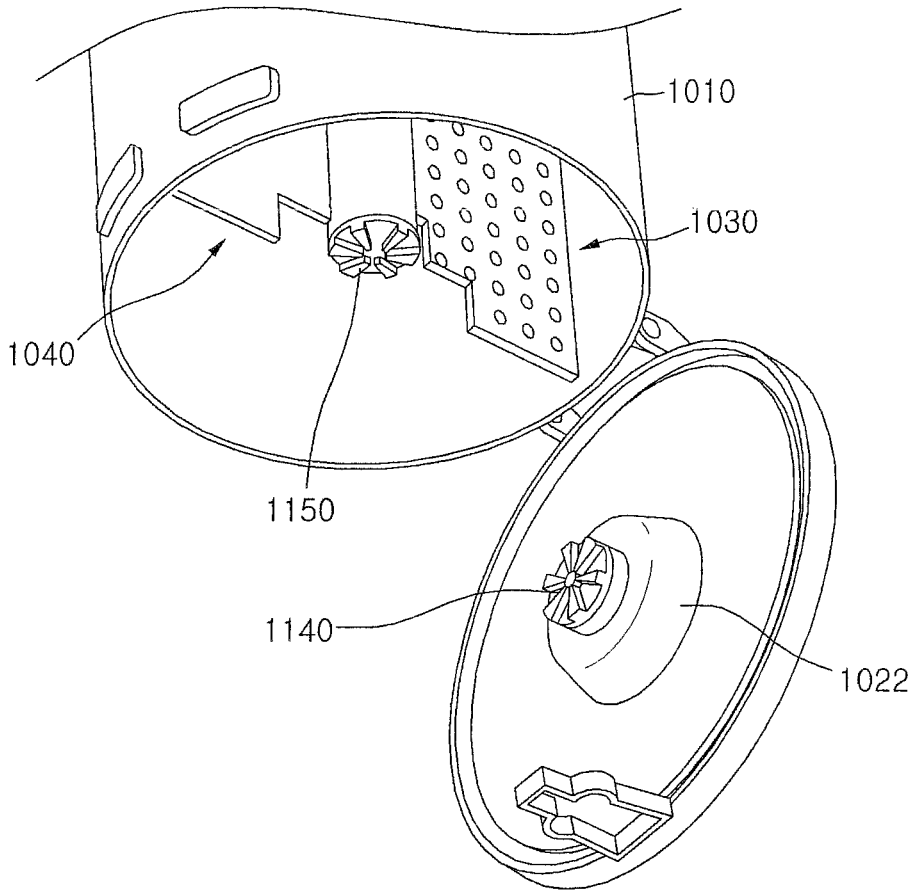
FIG. 32 is a perspective view of a dust container in a state in which a lower cover is open according to an embodiment.
Figure 33:
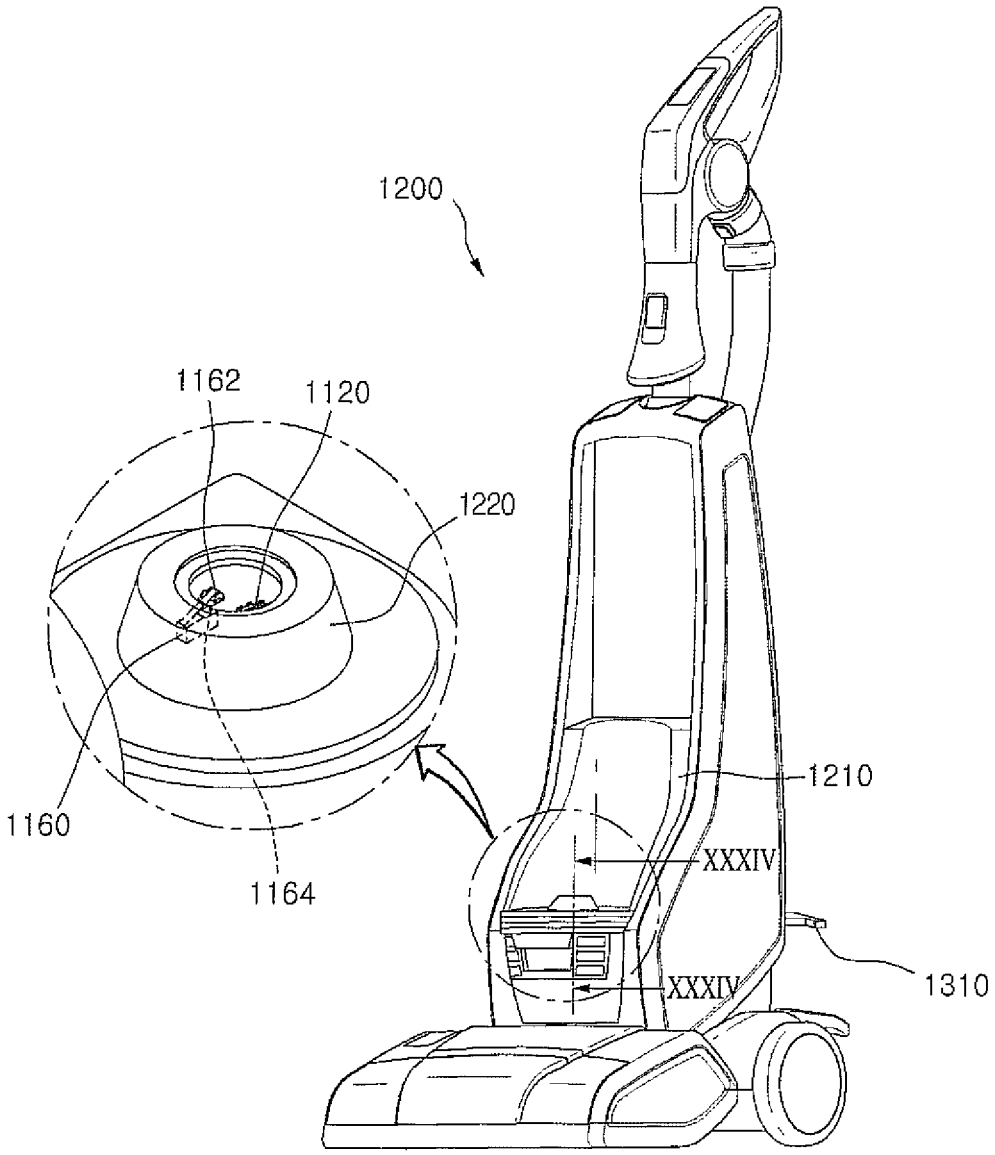
FIG. 33 is a perspective view illustrating a main body of a vacuum cleaner according to another embodiment.

FIG. 31 is a sectional view taken along line XXXI-XXXI of FIG. 28. FIG. 32 is a perspective view of a dust container in a state in which a lower cover is open. FIG. 33 is a perspective view illustrating a main body of a vacuum cleaner according the another embodiment.

Referring to FIGS. 31 to 33, the dust container 1000 according to this embodiment may include a dust collector body 1010 in which a chamber that stores dust may be disposed and a lower cover 1020 that covers a lower portion of the dust collector body 1010. The dust collector body 1010, for example, may have a cylindrical shape and an open lower side; however, embodiments are not limited thereto.

Similar to the embodiment of FIG. 1, the lower cover 1020 may be rotatably coupled to the dust collector body 1010 by a hinge. Also, a protrusion part 1022 may be disposed at a central portion of the lower cover 1020.

The dust collector body 1010 may include a plurality of compression members 1030 and 1040 that compress the dust stored in the dust collector body 1010. The plurality of compression members 1030 and 1040 may include a first compression member 1030 movably disposed within the dust collector body 1010 and a second compression member 1040 fixed to an inner circumference surface of the dust collector body 1010. For example, the first compression member 1030 may be rotatably disposed within the dust collector body 1010, and the second compression member 1030 may be integrated with an inner circumferential surface of the dust collector body 1010.

In more detail, the first compression member 1030 may include a rotation shaft 1034 and a first compression plate 1032 integrated with the rotation shaft 1034 to compress the dust. A cleaning member 1037 for cleaning the inner circumferential surface of the dust collector body 1010 may be coupled to a lateral surface of the first compression plate 1032. The cleaning member 1037 may be slidably vertically coupled to a lateral portion of the first compression plate 1032 or may be integrated with a lateral portion of the first compression plate 1032 by, for example, inserted-injection molding. In a case in which the cleaning member 1037 is slidably coupled to the first compression plate 1032, a coupling part coupled to a portion of the cleaning member 1037 may be disposed on the lateral portion of the first compression plate 1032.

For example, the cleaning member 1037 may be formed of for example, a rubber material. The cleaning member 1037 may contact the inner circumferential surface of the dust collector body 1010. When the first compression member 1030 is rotated, the cleaning member 1037 may be rotated in a state in which it contacts the inner circumferential surface of the dust collector body 1010 to brush the dust (specifically, fine dust) on the inner circumferential surface of the dust collector body 1010.

Thus, since the inner circumferential surface of the dust collector body 1010 is cleaned, a user may easily confirm an amount of the dust stored in the dust collector body 1010 from the outside. To confirm an amount of the dust stored in the dust collector body 1010 from the outside, the dust collector body 1010 may be formed of, for example, a transparent material.

The second compression member 1040 may include a second compression plate 1042 that compresses the dust by an interaction between the second compression member 1040 and the first compression plate 1032. A fixed shaft 1044, to which the rotation shaft 1034 may be coupled, may be disposed on an upper wall of the dust collector body 1010. The fixed shaft 1044 may extend downwardly from an upper wall of the dust collector body 1044. The second compression plate 1042 may be integrated with the fixed shaft 1044.

Portions of lower portions of the first compression plate 1032 and the second compression plate 1042 may be cut to prevent the first and second compression plates 1032 and 1042 from interfering with the protrusion part 1022. Thus, the lower portions of the first and second compression plates 1032 and 1042 may be disposed between the protrusion part 1022 and the inner circumferential surface of the dust collector body 1010.

A coupling shaft 1035 coupled to the fixed shaft 1044 may be disposed within the rotation shaft 1034. A coupling boss 1046, in which the coupling shaft 1035 may be inserted, may be disposed on the fixed shaft 1044. The coupling shaft 1035 may be inserted into the coupling boss 1046 from a downward direction of the fixed shaft 1044. Also, a coupling member 1036 may be coupled to the coupling shaft 1035 from the outside of the dust collector body 1010 in a state in which the coupling shaft 1035 is inserted into the coupling boss 1046.

Since a principle by which the dust is compressed by the first compression plate 1032 and the second compression plate 1042 is the same as that of the embodiment of FIG. 1, repetitive description has been omitted. The first compression member 1030 may be automatically moved by a driving device. The driving device may include a driving source that drives the first compression member 1030 and a power transmission device that transmits a power of the driving source to the first compression member 1030.

For example, the compression motor (see reference numeral 410 of FIG. 19) may be used as the driving source. As characteristics and operations of the compression motor (see reference numeral 410 of FIG. 19) were described with reference to the embodiment of FIG. 1, repetitive description has been omitted. The compression motor (see reference numeral 410 of FIG. 19) may be disposed below the protrusion part 1022.

The power transmission device may include a main body transfer part 1120 coupled to the compression motor (see reference numeral 410 of FIG. 19) and disposed in a cleaner main body 1200 and a transfer device selectively connected to the main body transfer part 1120.

The transfer device may include a first transfer part 1130, a second transfer part 1140, and a connection part 1150. The first transfer part 1130 may be disposed below the protrusion part 1022. The second transfer part 1140 may be disposed above the protrusion part 1022 and coupled to the first transfer part 1130. The connection part 1150 may be selectively connected to the second transfer part 1140.

For example, a gear may be utilized as each of the main body transfer part 1120 and the first transfer part 1130. When the dust separator 700 is mounted on the cleaner main body 1200, the first transfer part 1130 may be engaged with the main body transfer part 1120.

The first transfer part 1130 and the second transfer part 1140 may be coupled to each other by a coupling member 1142. Thus, when the first transfer part 1130 is rotated, the second transfer part 1140 may be rotated as well.

The connection part 1150 may be integrated with a lower portion of the rotation shaft 1034. On the other hand, the connection part 1150 may be provided separate from the rotation shaft 1032 and coupled to the lower portion of the rotation shaft 1034.

When the lower cover 1020 closes a lower side of the dust collector body 1010, the second transfer part 1140 may be disposed inside the dust collector body 1010 and connected to the connection part 1150. When the lower cover 1020 opens the lower side of the dust collector body 1010, the connection between the connection part 1150 and the second transfer part 1140 may be released.

In this embodiment, for example, a plurality of uneven parts engaged with each other may be disposed on each of contact surfaces between the second transfer part 1140 and the connection part 1150. That is, in this embodiment, a clutch structure may be utilized for the second transfer part 1140 and the connection part 1150, as an example.

However, the connection structure between the second transfer part 1140 and the connection part 1150 is not limited to the above-described structure. For example, the second transfer part 1140 and the connection part 1150 may be selectively connected to each other using various methods. Thus, according to the spirit of this embodiment, provided are a first guide part having various structures and disposed on the second transfer part 1140, and a second guide part having various structures disposed on the connection part 1150 and selectively coupled to the first guide part.

Referring to FIG. 33, a mounting part 1210 on which the dust separator 700 may be mounted, may be disposed in the main body 1200. The mounting part 1210 may have a shape corresponding to that of the protrusion part 1022. A mounting guide 1220, which may be inserted into the protrusion part 1022, may be disposed on the mounting part 1210. The mounting guide 1220 may protrude upwardly from a bottom surface of the mounting part 1210.

The main body transfer part 1120 may be disposed on the mounting guide 1220. A portion of the main body transfer part 1120 may be disposed within the main body 1200, the other portion of the main body transfer part 1120 may pass through the main body 1200 and be exposed to the mounting part 1210.

Also, a mounting detection part that detects the mounting of the dust container (or the dust separator) may be disposed on the mounting guide 1220. For example, a micro switch 1160 may be utilized for the mounting detection part. The micro switch 1160 may include a lever 1162 that turns on/off the micro switch 1160.

The micro switch 1160 may be disposed inside the main body 1200. A portion of the lever 1162 may be exposed to the outside of the mounting guide 1220. When the dust separator 700 is mounted on the mounting part 1210, the lever 1160 may be rotated to compress a contact point 1164 of the micro switch 1160, thereby turning on the micro switch 1160. Then, an ON signal of the micro switch 1160 may be transmitted to a controller (not shown), and the controller may detect that the dust separator 700 is mounted on the cleaner main body 1200.

On the other hand, when the dust separator 700 is separated from the mounting part 1210, since the lever 1162 compressing the contact point 1164 of the micro switch 1160 is spaced from the contact point 1164, the micro switch 1160 may be turned off. Then, an OFF signal of the micro switch may be transmitted to the controller (not shown), and the controller may detect that the dust separator 700 is separated from the dust main body 1200.

When a suction motor operation signal is input in a state in which the dust separator 700 is not mounted, a dust separator non-installation signal may be generated by a signal generator (not shown). Also, when the dust separator is separated from the main body in a state in which the dust separator is mounted and the suction motor is operated, the dust separator non-installation signal may be generated in the signal generator.

Figure 34:
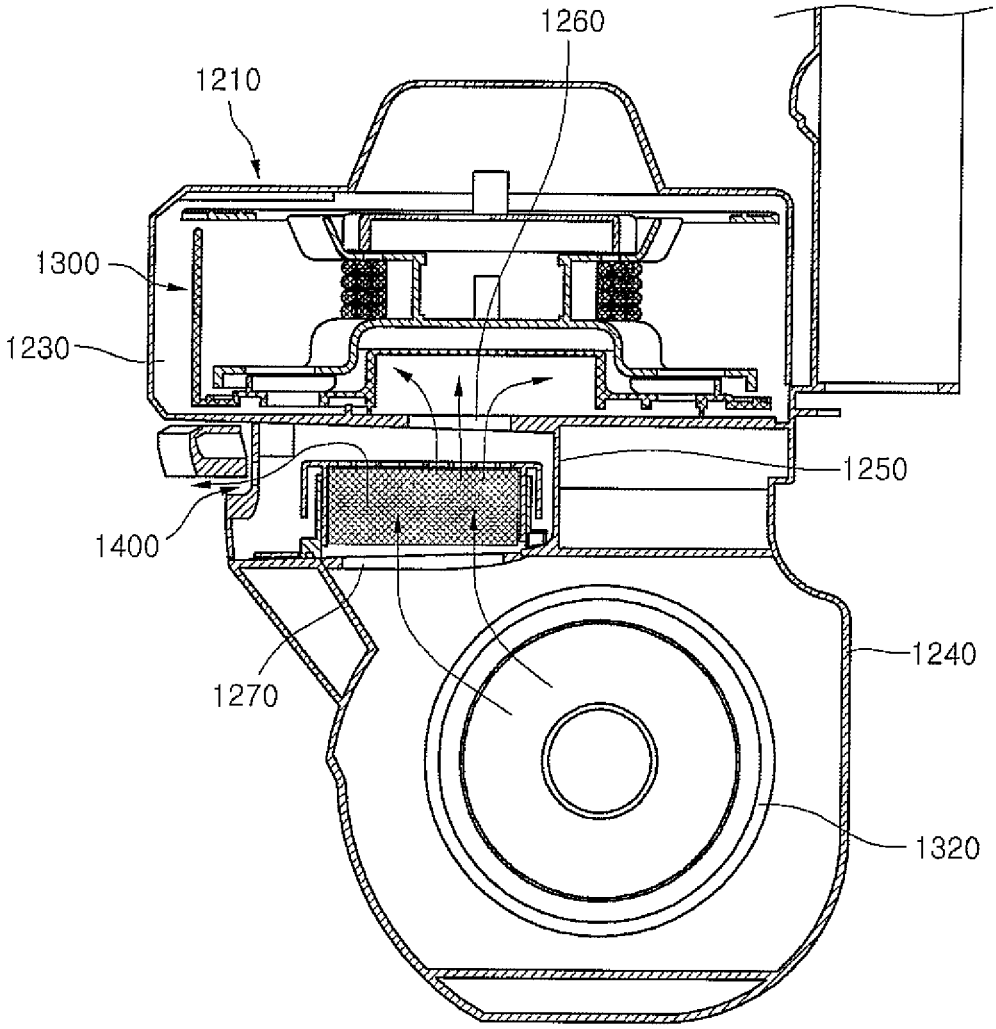
FIG. 34 is a sectional view taken along line XXXIV-XXXIV of FIG. 33.

FIG. 34 is a sectional view taken along line XXXIV-XXXIV of FIG. 33. Referring to FIGS. 33 and 34, a cord reel 1300, around which a power cord that supplies power to the cleaner main body 1200 may be wound, may be disposed within the main body 1200. A cord reel chamber 1230, in which the cord reel 1300 may be received, may be disposed inside the mounting part 1210. The cord reel chamber 1230 may be disposed below the protrusion part 1220. A cord reel lever 1310, by which the loose power cord may be wound by a user's operation, may be disposed at a rear side of the main body 1200. For this embodiment, since a well-known component may be used as the cord reel 1300, detailed description with respect to a structure of the cord reel 1300 has been omitted.

An exhaust filter device 1400 that filters air passing through a suction motor 1320 may be disposed below the cord reel 1300. A filter device chamber 1250 configured to receive the exhaust filter device 1400 may be disposed in the main body 1200. A front surface of the main body 1200 may be depressed backwardly to form the filter device chamber 1250. The exhaust filter device 1400 may be selectively received into the filter device chamber 1250 at a front side of the main body 1200.

A suction motor 1320 that generates a suction force may be disposed below the exhaust filter device 1400. The suction motor 1320 may be received into a motor chamber 1240 disposed below the filter device chamber 1250.

Thus, the cord reel 1300 may be disposed below the dust separator 700 in a state in which the dust separator 700 is mounted on the main body 1200. The exhaust filter device 1400 may be disposed below the cord reel 1300. The suction motor 1320 may be disposed below the exhaust filter device 1400.

The cord reel chamber 1230 and the filter device chamber 1250 may be connected to one another by a connection passage 1260. The motor chamber 1240 and the filter device chamber 1250 may communicate with each other through an exhaust passage 1270. Thus, air exhausted from the dust separator 700 may flow into the cleaner main body 1200, and then pass through the suction motor 1320. The air passing through the suction motor 1320 may be moved to the filter device chamber 1250 through the exhaust passage 1270. The air moved to the filter device chamber 1250 may be filtered while passing through the exhaust filter device 1400. A portion of the filtered air may be exhausted to the outside of the main body 1200, and the other portion of the filtered air may be moved to the cord reel chamber 1230 through the connection passage 1260.

As described above, since the cord reel 1300 may be disposed inside the vacuum cleaner main body, the power cord may not be exposed to the outside when the main body is stored, thereby improving an outer appearance of the vacuum cleaner. Also, since a portion of the air passing through the exhaust filter device 1400 may be moved to the cord reel chamber 1230 to cool the cord reel 1300, it may prevent the cord reel from increasing in temperature. Additionally, as the cord reel chamber 1230 is disposed directly above the exhaust filter device 1400, a passage of the air for cooling the cord reel 1300 may be short, and also, the structure may be simplified.

Figure 35:
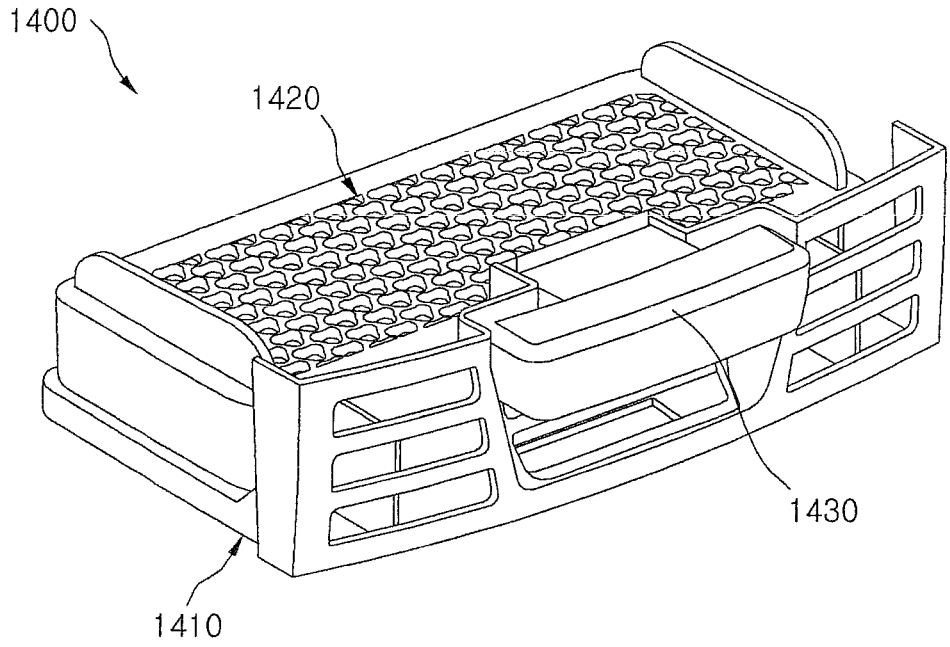
FIG. 35 is a perspective view of an exhaust filter device according to another embodiment.
Figure 36:
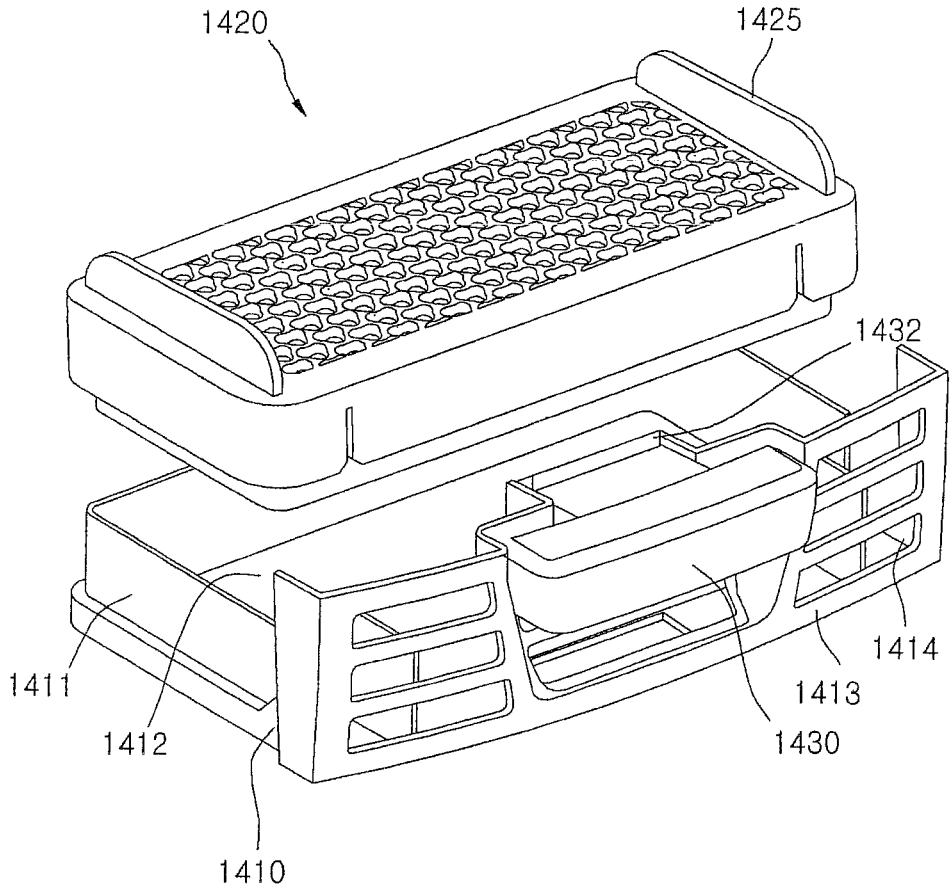
FIG. 36 is another perspective view of the exhaust filter device of FIG. 35.
Figure 37:
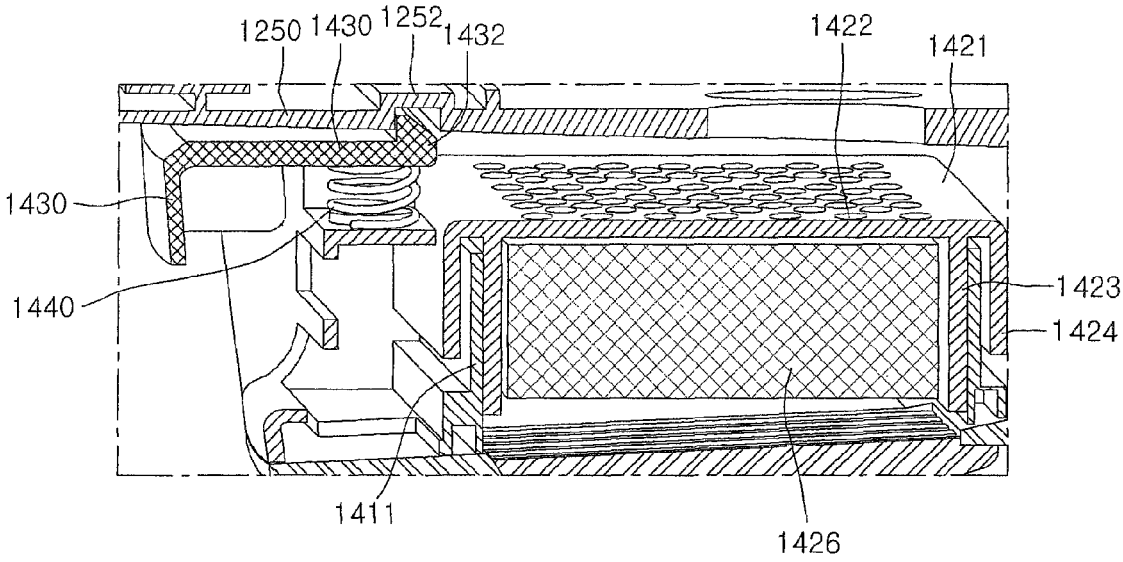
FIGS. 37 and 38 are views illustrating a mounting structure of the exhaust filter device of FIG. 36.
Figure 38:
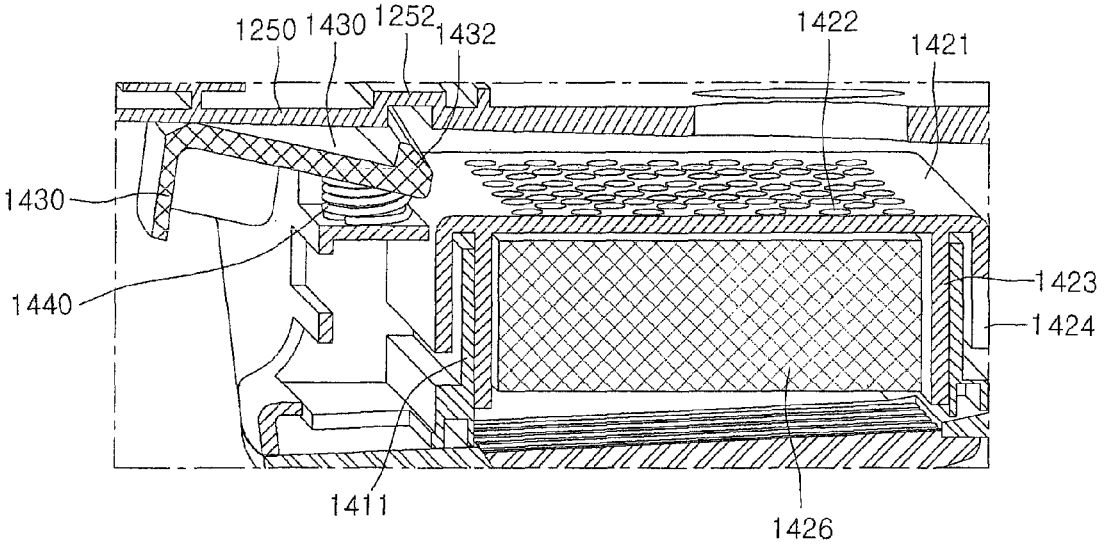

FIG. 35 is a perspective view of an exhaust filter device according to another embodiment. FIG. 36 is a perspective view of the exhaust filter device of FIG. 35. FIGS. 37 and 38 are views illustrating a mounting structure of the exhaust filter device of FIG. 35. FIG. 37 illustrates a state in which a filter lever is hooked on the vacuum cleaner main body, and FIG. 38 illustrates a state in which the hooking of the filter lever is released.

Referring to FIGS. 35 and 38, the exhaust filter device 1400 filters the air exhausted to the outside of the main body 1200.

The exhaust filter device 1400 may include a filter body 1420 that protects a filter 1426 and a filter housing 1410, in which the filter body 1420 may be received. The filter housing 1410 may include an outer wall 1411 that defines a space 1412 in which the filter body 1420 may be received.

A cover part 1413 may be disposed at a front side of the outer wall 1411. The cover part 1413 may cover a front surface of the filter body 1420 and may be exposed to an outer surface of the main body 1200 in a state in which the exhaust filter device 1400 is mounted on the filter device chamber 1250. That is, the cover part 1413 may define a portion of the outer appearance of the front surface of the main body 1200.

A plurality of exhaust holes 1414, through which air may pass, may be defined in the cover part 1413. The filter lever 1430, which may be configured to allow the exhaust filter device 1400 to be selectively coupled to an inner wall of the filter device chamber 1250, may be rotatably coupled to a central portion of the cover part 1413. An elastic member 1440 that elastically supports the filter lever 1430 may be disposed below the filter lever 1430. The elastic member 1440 may support a lower portion of the filter lever 1430 in a state in which the elastic member 1440 is seated on the cover part 1413.

The filter body 1420 may have a top surface 1421, an inner wall 1423, and an outer wall 1424. A plurality of holes 1422, through which air may pass, may be defined in the top surface 1421. The inner wall 1423 may extend downwardly from an under surface of the top surface 1421 to surround the filter 1426. The outer wall 1424 may surround the inner wall 1423 in a state in which the outer wall 1424 is spaced from the inner wall 1423.

The filter body 1420 may be seated on the filter housing 1410. When the filter body 1420 is seated on the filter housing 1410, the outer wall 1411 of the filter housing 1410 may be disposed between the inner wall 1423 and the outer wall 1424 of the filter body 1420.

A plurality of guide ribs 1425 may be disposed on both sides of the top surface 1421 to guide the air passing through the holes 1422 toward the cover part 1413 and prevent the air from laterally leaking. The plurality of guide ribs 1425 may extend in front and rear directions of the exhaust filter device 1400.

Referring to FIGS. 37 and 38, a hook hanger 1252, on which a hook 1423 of the filter lever 1430 may be hooked, may be disposed on the inner wall of the filter device chamber 1250. A portion of the inner wall of the filter device chamber 1250 may be depressed upwardly to form the hook hanger 1252.

Referring to FIG. 37, to separate the exhaust filter device 1400 from the main body 1200, a front portion of the filter lever may be grasped to lift the filter lever 1430. Thus, the filter lever 1430 may be rotated, as illustrated in FIG. 38, and the hook 1432 may be separated from the hook hanger 1252. As a result, the exhaust filter device 1400 may be separated from the filter device chamber 1250.

Thereafter, the filter lever may be pull forwardly. Thus, the exhaust filter device 1400 may be separated from the filter device chamber 1250.

According to this embodiment, as the filter housing 1410 and filter body 1420 may be separated from the main body 1200, the exhaust filter device 1400 may be easily separated. That is, as the filter housing 1410 and the filter body 1420 may be separated from the main body 1200 by pulling the filter lever 1430 in a state in which the filter lever 1430 is rotated, the separation process may be reduced to improve a user's convenience.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A vacuum cleaner, comprising:

a main body;

a suction nozzle in communication with the main body, that sucks air into the main body;

a dust separator removably coupled to the main body, the dust separator separating dust from the air sucked into the main body by the suction nozzle and comprising:

a dust separator device that separates dust from air sucked into the dust separator;

a dust container configured to store the separated dust, wherein the dust container comprises:

a dust container body;

at least one compression member to compress the dust within the dust container;

a lower cover attached to the dust container body;

a driving device configured to automatically rotate the at least one compression member and having a drive source located on the main body; and a power transmission device configured to transmit power from the drive source to the at least one compression member, wherein the power transmission device comprises a main body transfer part and a transfer device selectively connected to the main body transfer part, the transfer device having a first transfer part provided at a lower side of the lower cover and a second transfer part provided at an upper side of the first transfer part and connected to the first transfer part, wherein the second transfer part transmits power from the drive source to the at least one compression member, and wherein, when the lower cover opens an inner space of the dust container body by rotation, the first and second transfer parts remain connected to the lower cover for movement with the lower cover.

2. The vacuum cleaner of claim 1, wherein the at least one compression member comprises a rotatable first compression member and a fixed second compression member.

3. The vacuum cleaner of claim 2, wherein the second compression member is attached to a fixed shaft, and wherein the fixed shaft is integrated with a top surface of the dust container.

4. The vacuum cleaner of claim 3, wherein the fixed shaft includes a coupling boss that extends downward therefrom configured to be inserted into a rotatable shaft of the first compression member, and wherein an insertion member couples the rotatable shaft to the coupling boss.

5. The vacuum cleaner of claim 4, wherein the drive source comprises a compression motor.

6. The vacuum cleaner of claim 2, wherein the power transmission device further comprises:

a fixed part disposed on the second transfer part and coupled to the first transfer part;

a connection part configured to be coupled to the rotation shaft and selectively coupled to the fixed part; and an elastic member disposed on the first transfer part to elastically support the second transfer part.

7. The vacuum cleaner of claim 6, wherein the first transfer part comprises a gear.

8. The vacuum cleaner of claim 7, wherein the first transfer part comprises:

a gear body;

a plurality of gear teeth disposed along a circumferential surface of the gear body;

a magnetic member disposed on the gear body; and a gear cover.

9. The vacuum cleaner of claim 8, further comprising a detector disposed on a mounting part of the main body, the mounting part being configured to receive the dust separator seated thereon, the detector being configured to detect a rotational position of the first compression member by detecting a magnetic force of the magnetic member.

10. The vacuum cleaner of claim 8, wherein a portion of the gear body passes through an opening in the lower cover, and wherein a rotation guide guides rotation of the portion.

11. The vacuum cleaner of claim 6, wherein the second transfer part comprises a hole at a central portion thereof and a plurality of guide protrusions.

12. The vacuum cleaner of claim 11, wherein the fixed part comprises an insertion protrusion at a central portion thereof and a plurality of positioning through holes.

13. The vacuum cleaner of claim 12, wherein the connection part comprises an insertion protrusion receiving part at a central portion thereof and a plurality of guide protrusion receiving parts.

14. The vacuum cleaner of claim 1, wherein the vacuum cleaner is an upright type vacuum cleaner.

* * * * *